US007215288B2

(12) United States Patent
Park et al.

(10) Patent No.: US 7,215,288 B2
(45) Date of Patent: May 8, 2007

(54) ELECTROMAGNETICALLY COUPLED SMALL BROADBAND MONOPOLE ANTENNA

(75) Inventors: Ikmo Park, Yongin-si (KR); Jong-Ho Jung, Yongin-si (KR); Young-Min Moon, Seoul (KR); Seong-Soo Lee, Suwon-si (KR); Young-Il Kim, Suwon-si (KR)

(73) Assignees: Samsung Electronics Co., Ltd. (KR); Ajou University Industry Cooperation Foundation (KR)

( * ) Notice: Subject to any disclaimer, the term of this patent is extended or adjusted under 35 U.S.C. 154(b) by 0 days.

(21) Appl. No.: 10/936,200

(22) Filed: Sep. 8, 2004

(65) Prior Publication Data

US 2005/0116867 A1 Jun. 2, 2005

(30) Foreign Application Priority Data

Sep. 8, 2003 (KR) ..... 10-2003-0062835
Sep. 2, 2004 (KR) ..... 10-2004-0070113

(51) Int. Cl.
*H01Q 1/24* (2006.01)

(52) U.S. Cl. ..... 343/702; 343/700 MS; 343/846

(58) Field of Classification Search ..... 343/702, 343/700 MS, 846
See application file for complete search history.

(56) References Cited

U.S. PATENT DOCUMENTS 3,852,760 A 12/1974 Reggia
3,967,276 A 6/1976 Goubau
4,724,443 A * 2/1988 Nysen ..... 343/700 MS
5,181,044 A 1/1993 Matsumoto et al.
5,289,198 A 2/1994 Altshuler
6,353,443 B1 3/2002 Ying
6,452,558 B1 9/2002 Saitou et al.
6,593,887 B2 * 7/2003 Luk et al. ..... 343/700 MS
6,781,553 B2 * 8/2004 Iguchi et al. ..... 343/725
6,922,171 B2 * 7/2005 Annamaa et al. .... 343/700 MS
2003/0107518 A1 6/2003 Li et al. ..... 343/702

FOREIGN PATENT DOCUMENTS

JP 63-258104 10/1988
WO WO 00/76023 12/2000
WO WO 02/065581 8/2002

OTHER PUBLICATIONS

Noguchi et al., Increasing the Bandwidth of a Normal Mode Helical Antenna Consisting of Two Strips, Antennas and Propagation Society International Symposium, 1998.

(Continued)

*Primary Examiner*—Hoang V. Nguyen
(74) *Attorney, Agent, or Firm*—The Farrell Law Firm

(57) ABSTRACT

A small broadband monopole antenna including a shorted patch and a probe with a strip line that are electromagnetically coupled with each other. The probe with a strip line has a length of about λ/4, where λ is a wavelength. The strip line may be one of a spiral type, a folded type and a helix type. A resonance frequency of the antenna can be adjusted by varying the inductance and the capacitance of the resonance circuits. In addition, a double-band antenna or a single-band antenna having a broad bandwidth can be designed in accordance with application purpose of the antenna.

29 Claims, 32 Drawing Sheets

OTHER PUBLICATIONS

Noguchi et al., Increasing the Bandwidth of a Meander Line Antenna Consisting of Two Strips, Antennas and Propagation Society International Symposium, 1997.

Olmos et al., Inverted F-Antennas with Wideband Match Performance, Electronic Letters, 2002.

Sakai et al., Directivity Gain Enhancement of Small Antenna by Parasitic Patch, Antennas and Propagation Society International Symposium, 1998.

Lee et al., A Novel Coupled Fed Small Antenna, Asia-Pacific Microwave Conference, 2001.

Guo et al., L-Probe Proximity-Fed Short-Circuited Patch Antennas, Electronics Letters, 1999.

Wang et al., Design of Small and Broad-band Internal Antennas for IMT-2000 Mobile Handsets, IEEE Transactions on Microwave Theory and Techniques, 2001.

Goldfarb et al., Modeling via Hole Grounds in Microstrip, IEEE Microwave and Guided Wave Letters, 1991.

Friedman, Wide-band Matching of a Small Disk-Loaded Monopole, IEEE Transactions on Antennas and Propagation, 1985.

Foltz et al., Closed-Form Lumped Element Models for Folded, Disk-Loaded Monopoles, Antennas and Propagation Society International Symposium, 2002.

Jeen-Sheen Row et al., A Wide-Band Monopolar Plate-Patch Antenna, IEEE Transactions on Antennas and Propagation, vol. 50, No. 9, Sep. 2002.

Delaveaud et al., New Kind of Microstrip Antenna: The Monopolar Wire-Patch Antenna, Electronic Letters, Jan. 6, 1994, vol. 30, No. 1.

* cited by examiner (x-z PLANE)

(y-z PLANE)

(x-z PLANE)

(y-z PLANE)

ELECTROMAGNETICALLY COUPLED SMALL BROADBAND MONOPOLE ANTENNA

PRIORITY

This application claims priority under 35 U.S.C. § 119 to applications entitled "Electromagnetically Coupled Small Broadband Monopole Antenna", filed in the Korean Intellectual Property Office on Sep. 8, 2003 and assigned Serial No. 2003-62835, and filed in the Korean Intellectual Property Office on Sep. 2, 2004 and assigned Serial No. 2004-70113, the contents of both of which are incorporated herein by reference.

BACKGROUND OF THE INVENTION

1. Field of the Invention

The present invention relates generally to an antenna, and more particularly to a small broadband monopole antenna including a shorted patch and a probe with a strip line that are electromagnetically coupled with each other. The probe with the strip line has a length of about λ/4, where λ is a wavelength.

2. Description of Prior Art

Recently, the wireless communication system has been diversely and rapidly developed into a cellular phone, a personal communication service (PCS), an international mobile telecommunication-2000 (IMT-2000), and a personal digital assistant (PDA) and its market also has been enlarged to provide services at a high speed. In the IMT-2000, which is also called a third generation mobile communication system, and to which a great deal of research and development have been done, diverse communication services are available not only for voice and low speed data but also for high speed multimedia data. Together with the developments of such a variety of mobile communication systems, many efforts have been also made to develop small personal portable communication terminals with a high performance. For the miniaturization of the communication terminals, it is commonly regarded that the embedded type small antenna is essential.

Commonly, the prior communication terminals widely used an external type retractable antenna such as a helical antenna or a monopole antenna. However, the external type retractable antenna is disadvantageous for the miniaturization of the communication terminals. A planar inverted F antenna (PIFA) and a short-circuit microstrip antenna are suggested as a small embedded antenna to replace the external type retractable antenna.

These antenna structures have a benefit of a simple design, but unfortunately have a narrow bandwidth. In order to improve the narrow bandwidth problem of the PIFA and the short-circuit microstrip antenna, several types of antennas are suggested such as a 2-lines type normal mode helical antenna (NMHA), a meander line antenna consisting of two strips, a double line PIFA antenna, and a PIFA with stacked parasitic elements. These antennas are detailed in the following: 1) K. Noguchi, M. Misusawa, T. Yamaguchi, and Y. Okumura, "Increasing the Bandwidth of a Meander Line Antenna Consisting of Two Strips," *IEEE AP-S Int Symp. Digest*, pp. 2198-2201, vol. 4, Montreal, Canada, July 1997; 2) K. Noguchi, M. Misusawa, M. Nkahama, T. Yamaguchi, Y. Okumura, and S. Betsudan, "Increasing the Bandwidth of a Normal Mode Helical Antenna Consisting of Two Strips," *IEEE AP-S Int Symp.*, pp. 782–785, vol. 2, Atlanta, USA, June 1998; 3) M. Olmos, H. D. Hristov, and R. Feick, "Inverted-F Antennas with Wideband Match Performance," *Electron. Lett.*, vol. 16, no. 38, pp. 845–847, August 2002; and 4) S. Sakai and H. Arai, "Directivity Gain Enhancement of Small Antenna by Parasitic Patch," *IEEE AP-S Int. Symp.*, pp. 320–323, vol. 1, Atlanta, USA, June 1998. Among these antennas, the meander line antenna can have wider bandwidth than that of the 2-lines type NMHA or the PIFA by offsetting a balanced mode (transmission line mode) with an unbalanced mode (radiation mode).

Other solutions for obtaining a wide bandwidth include a method of attaching a patch with a shorting wall to an L-strip feed or an L-prove feed and a method of electromagnetically coupling the PIFA with the shorted parasitic patch. These solutions are detailed in the following: 1) C. L. Lee, B. L. Ooi, M. S. Leong, P. S. Kooi, and T. S. Yeo, "A Novel Coupled Fed Small Antenna," *Asia-Pacific Microwave Conf.*, pp. 1044–1047, vol. 3, Taipei, Taiwan, December 2001; 2) Y. X. Gou, K. M. Luk, and, K. F. Lee, "L-Probe Proximity-Fed Short-Circuited Patch Antennas," *Electron. Lett.*, vol. 24, no. 35, pp. 2069–2070, November 1999; and 3) Y. J. Wang, C. K. Lee, W. J. Koh, and Y. B. Gan, "Design of Small and Broad-Band Internal Antennas for IMT-2000 Mobile Handsets," *IEEE Trans. Microwave Theory Tech.*, vol. 49, no. 8, August 2001. These antenna structures can satisfy with a bandwidth of 30% or more, but has have some restrictions in reducing antenna size since because the L-strip structure and a shorted patch should have a resonance length of about λ/4.

For example, U.S. Pat. No. 6,452,558 entitled "Antenna Apparatus and a Portable Wireless Communication Apparatus" discloses a diversity antenna constructed by contacting a planar inverted F antenna (PIFA) with a monopole antenna. The diversity antenna uses two receiving antennas to create two paths for receiving electromagnetic waves in order reduce a fading phenomenon.

As another example, U.S. Pat. No. 5,289,198 entitled "Double-Folded Monopole Antenna" discloses an antenna that is constructed by folding a wire monopole antenna. This antenna has a total length equal to 1.0 λ of a resonance frequency and uses a traveling wave for its operation. The antenna does not use electromagnetic coupling with the shorted patch.

In addition, Korean Patent Application No. 10-2001-7000246 (with a U.S. counterpart application Ser. No. 09/112,366 filed on Jul. 9, 1998), entitled "Small Printed Spiral Type Antenna for Mobile Communication Terminals", discloses an antenna structure of a spiral type monopole antenna and uses a method of directly connecting a grounding post to the spiral type monopole antenna to achieve an impedance matching. However, these antennas have different structures and characteristics from the antenna according to the present invention as will be described below.

SUMMARY OF THE INVENTION

It is an object of the present invention to provide a monopole antenna that can easily realize a single broadband or a dual band, and has several good characteristics such as a small electrical size, a low resonance frequency, and an impedance-matching-easy structure that does not require a separate matching circuit.

According to the present invention, for achieving the above and other objects, adjustments for the parallel capacitance and the series inductance of the antenna itself are used. A small broadband monopole antenna is provided that includes a shorted patch and a probe with a strip line with a length of about 0.25λ, where λ is a wavelength. Wide impedance bandwidth can be achieved through electromagnetic coupling between the shorted patch and the probe with a strip line that generate two resonances, parallel resonance from the shorted patch and series resonance from the probe with a strip line, closely spaced in frequency.

In the antenna, the strip line has a shape selected from a group of a spiral shape, a helix shape, and a folded shape that is made by folding a straight strip line. A wire can also be used instead of the strip line. By designing an antenna to have the shape and length as described above, the antenna can have a resonance length within a minimum space.

In order to achieve a small size and a wide bandwidth of an antenna, it is preferable that the shorted patch being operative as a monopole antenna of capacitive component should be electromagnetically coupled to the probe with a strip line as a monopole antenna of inductive component.

As a design scheme to obtain a wider bandwidth, it is preferable to position a resonance frequency of the probe with a strip line and a resonance frequency of the shorted patch at adjacent points with each other because the two resonance frequencies are adjustable. Furthermore, it is possible to design the antenna to have a dual-band by making the two resonance frequencies be different from each other.

The antenna suggested by the present invention is small size and has an omni-directional monopole radiation pattern. Accordingly, the antenna is applicable as an embedded antenna for mobile communication devices or a wireless local area network (LAN) because it enables data communication at any direction.

BRIEF DESCRIPTION OF THE DRAWINGS

The above and other objects, features, and advantages of the present invention will become more apparent from the following detailed description when taken in conjunction with the accompanying drawings in which.

DETAILED DESCRIPTION OF THE PREFERRED EMBODIMENTS

Hereinafter, detailed descriptions of preferred embodiments of the present invention will be given with reference to the attached drawings. In the following descriptions, any detailed description of known functions and configurations incorporated herein has been omitted for conciseness.

Figure 1A:
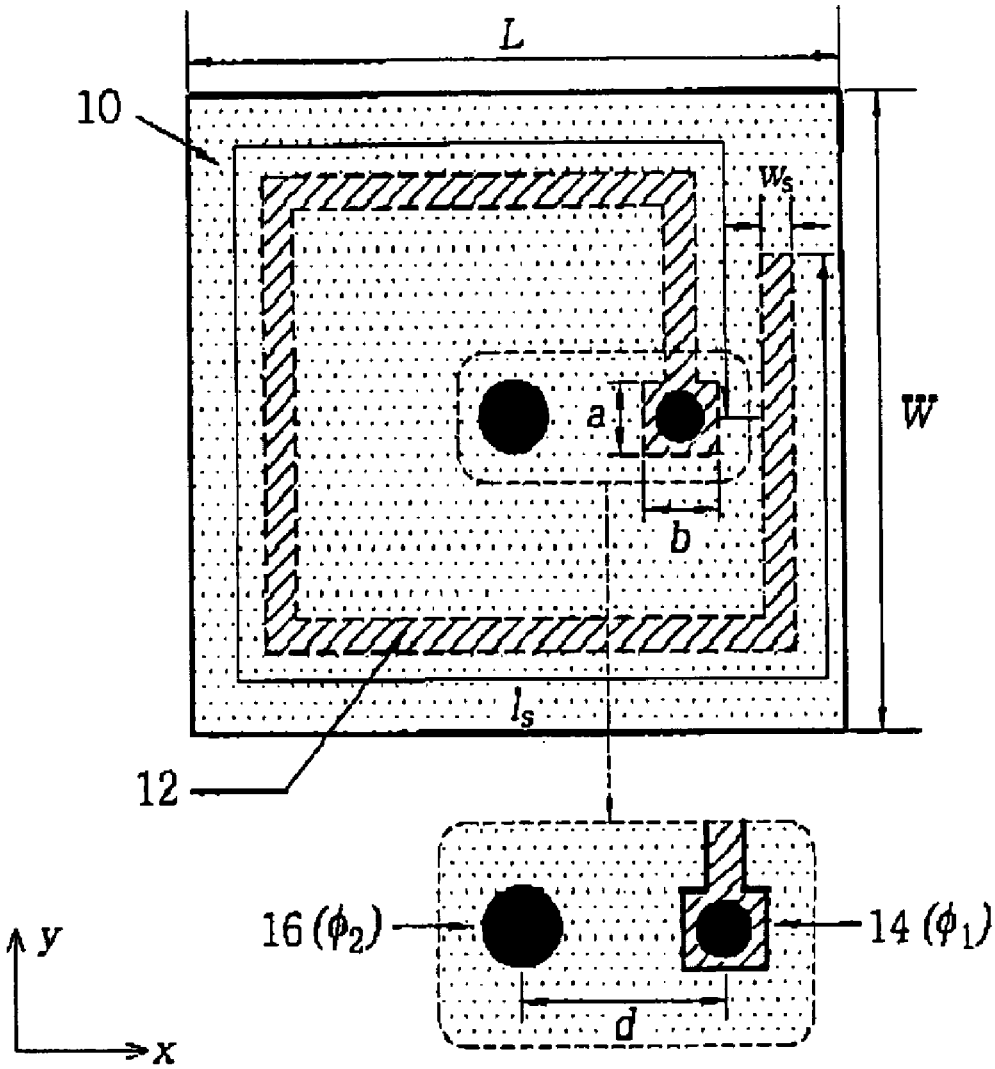
FIGS. 1A, 1B, and 1C are a top view, a side view, and a perspective view, respectively, of a monopole antenna including a shorted rectangular patch and a probe with a rectangular spiral strip line, in accordance with an embodiment of the present invention.
Figure 1B:
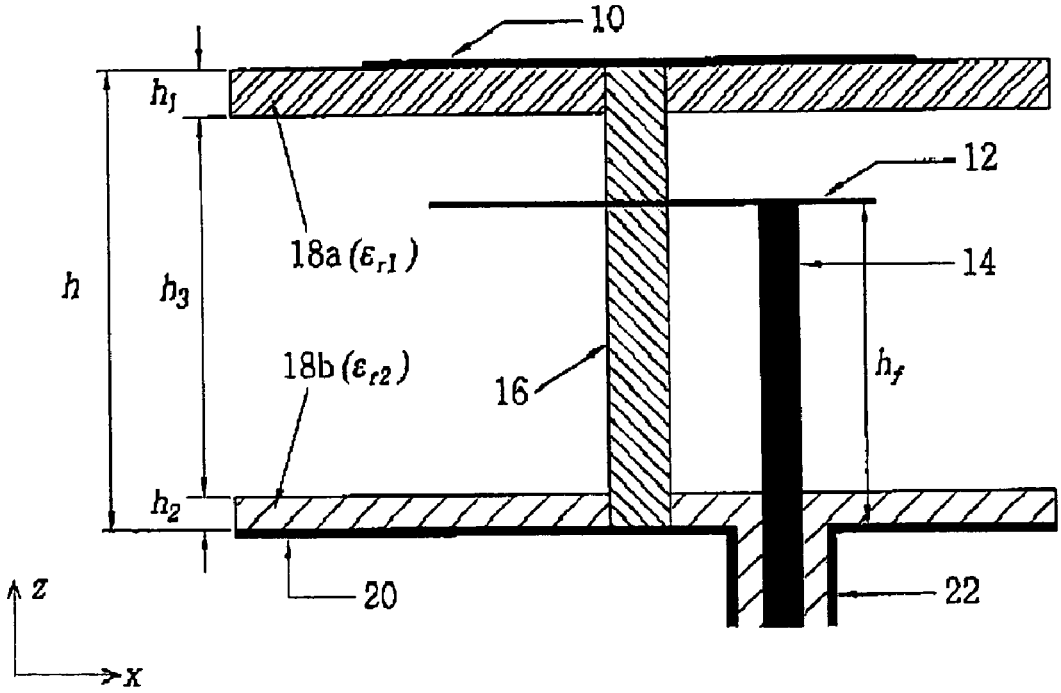

The present invention provides several structures of monopole antennas. In one embodiment in accordance with the present invention, a monopole antenna includes a shorted rectangular patch 10 and a probe 14 with a rectangular spiral strip line 12, as illustrated in FIGS. 1A, 1B, and IC. Preferably, the spiral strip line 12 has a rectangular shape, where its total length is $l_s$ and its width is $w_s$.

The probe 14 has a diameter $\Phi_1$ at a height $h_f$ from a ground plane 20. The sum of the length $l_s$ of the spiral strip line 12 and the probe height $h_f$ from the ground plane 20 is equal to about 0.25λ. In general, a monopole antenna that is perpendicular to the ground plane 20 has a resonance length of about 0.25λ. Therefore, by a design scheme to construct the strip line as a spiral type, it becomes possible to design the monopole antenna to have the least volume and the longest resonance length. In addition, the probe with a spiral strip line 12 can be modeled into an equivalent circuit of series RLC, where R is a radiation resistance, L is a series inductance, and C is a capacitance 12. However, to reduce the size of the probe with a spiral strip line 12, its vertical height is reduced and a shape of the strip line is constructed as the spiral type, but such a design scheme may bring decrease of radiation resistance of the antenna. Therefore, the resonance frequency of the probe with a spiral strip line 12 may give a poor characteristic of resonance as compared with a vertical type monopole.

In order to improve the resonance characteristic and bandwidth of the probe with a spiral strip line 12, a shorted patch 10, which is electromagnetically coupled to the probe 14 with a spiral strip line 12, is added. Preferably, the shorted patch 10 is square shaped, where its length, width, and height from the ground plane 20 are L, W, and h, respectively. The center of the shorted patch 10 is connected to a ground plane 20 through a shorting pin 16 of diameter $\Phi_2$. To reduce the size of the shorted patch 10, a high permittivity dielectric substrate 18*a* is added on the lower surface of the shorted patch 10. A dielectric substrate 18*b* may be further added on the ground plane 20. The distance between the probe 14 and the shorting pin 16 is d. The shorted patch 10 improves the impedance matching characteristic of the probe 14 with a spiral strip line 12 and causes a resonance due to an effect of the electromagnetic coupling with the probe 14 with a spiral strip line 12, which functions as a disk-loaded monopole antenna having a capacitive component. In addition, the shorted patch 10 is modeled into an equivalent circuit of parallel RLC resonance circuit. Therefore, in the structure including a shorted patch 10 and a probe 14 with a spiral strip line 12, the probe 14 with a spiral strip line 12 that generate series resonance and the shorted patch 10 that generates parallel resonance are electromagnetically coupled each other, and operate as a monopole antenna. The resonance characteristic of the antenna can be adjusted by varying values of inductance and/or capacitance of the probe 14 with a spiral strip line 12 and the shorted patch 10. Consequently, these features amenable the designing of an antenna having such characteristics as a wide single-band or dual-band.

Figure 2A:
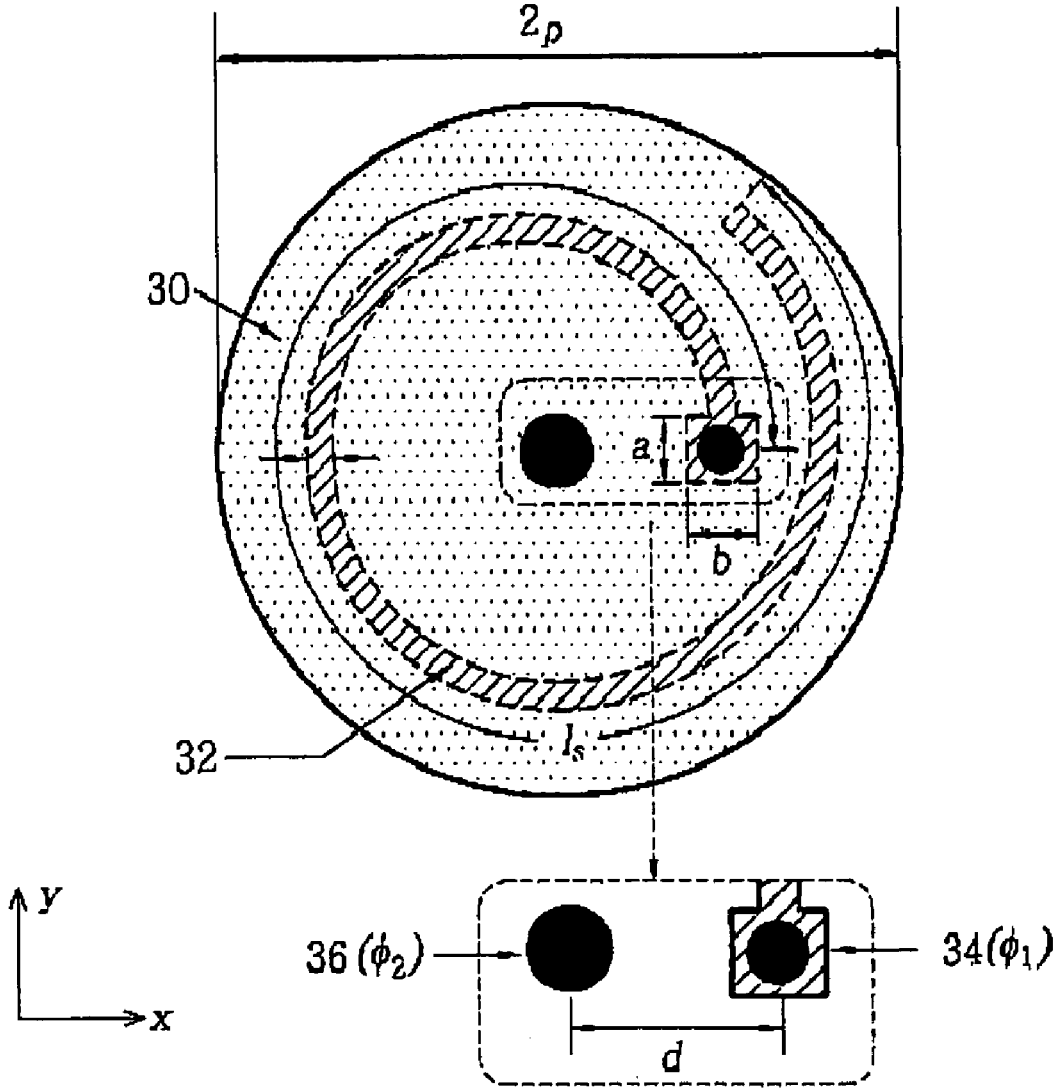
FIGS. 2A and 2B are a top view and a side view of a monopole antenna including a shorted circular patch and a probe with a circular spiral strip line, respectively, in accordance with an embodiment of the present invention.
Figure 2B:
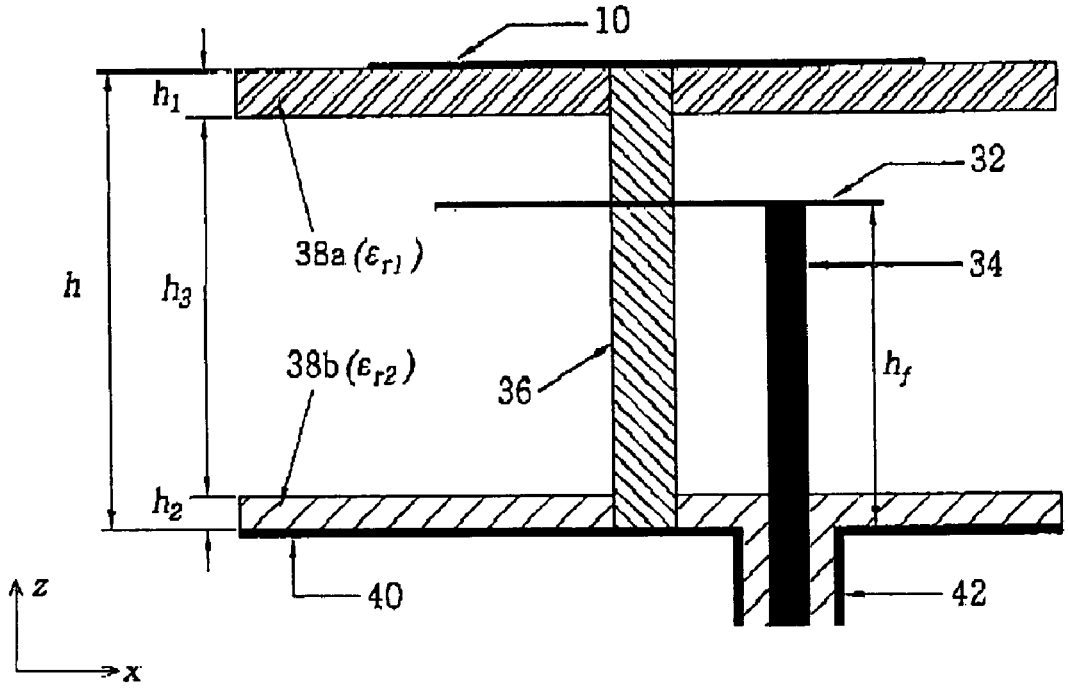

FIGS. 2A and 2B illustrate a structure of a shorted circular patch and a probe with a circular spiral strip line in another embodiment of the monopole antenna in accordance with the present invention. In FIGS. 2A and 2B, the total length and width of a circular spiral strip line 32 are $l_s$ and $w_s$, respectively.

Referring to FIGS. 2A and 2B, a probe 34 with a spiral strip line 32 has a diameter $\Phi_1$ at a height $h_f$ from a ground plane 40. The sum of the length $l_s$ of the spiral strip line 32 and the height of the probe 34 from the ground plane 40 becomes about 0.25λ. A shorted circular patch 30 is electromagnetically coupled to the probe with a circular spiral strip line 32 and has a diameter of 2ρ and a height of h. The center of the circular patch 30 is connected to the ground plane 40 through a shorting pin 36 with a diameter of $\Phi_2$. The distance between the probe 34 and the shorting pin 36 is d. Similarly to the antenna illustrated in FIGS. 1A, 1B, and 1C, a dielectric substrate 38*a* of a high permittivity may be added to the bottom surface of the circular patch 30 and a dielectric substrate 38*b* may be added on the ground plane 40.

A helix type strip line can be constructed by slightly modifying the spiral type strip line. However, even in the helix type strip line its length should be equal to about 0.25λ.

Figure 3A:
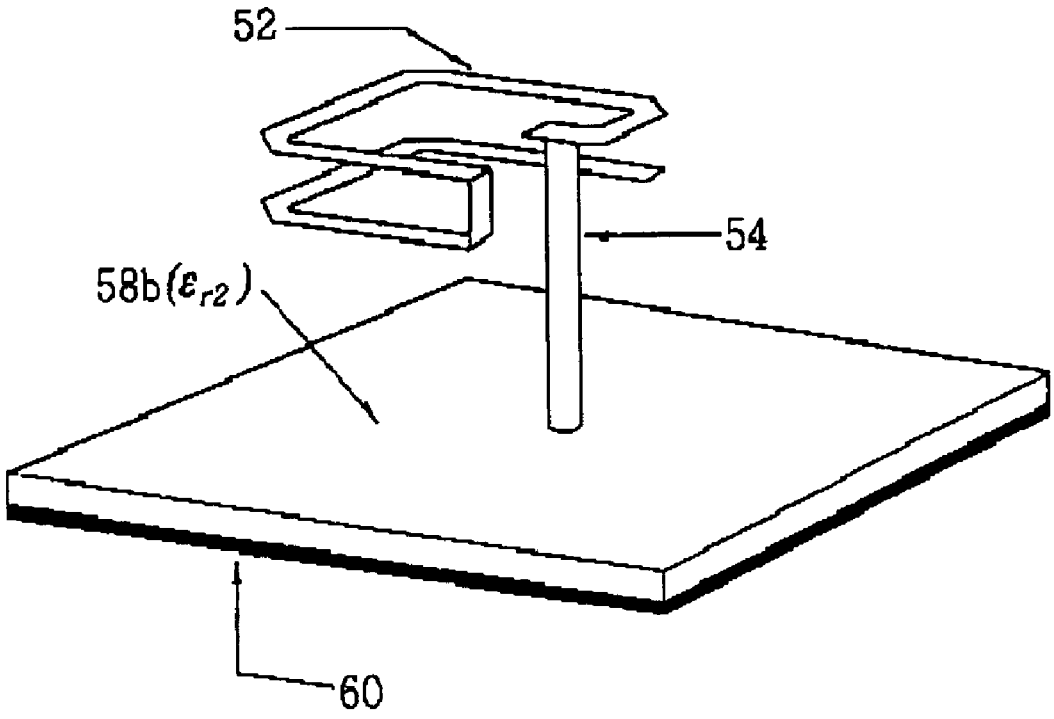
FIGS. 3A, 3B, 3C, and 3D are a perspective view, a partial detailed view, a top view, and a side view, respectively, of a monopole antenna including a shorted patch and a probe with a folded strip line, in accordance with an embodiment of the present invention.
Figure 3B:
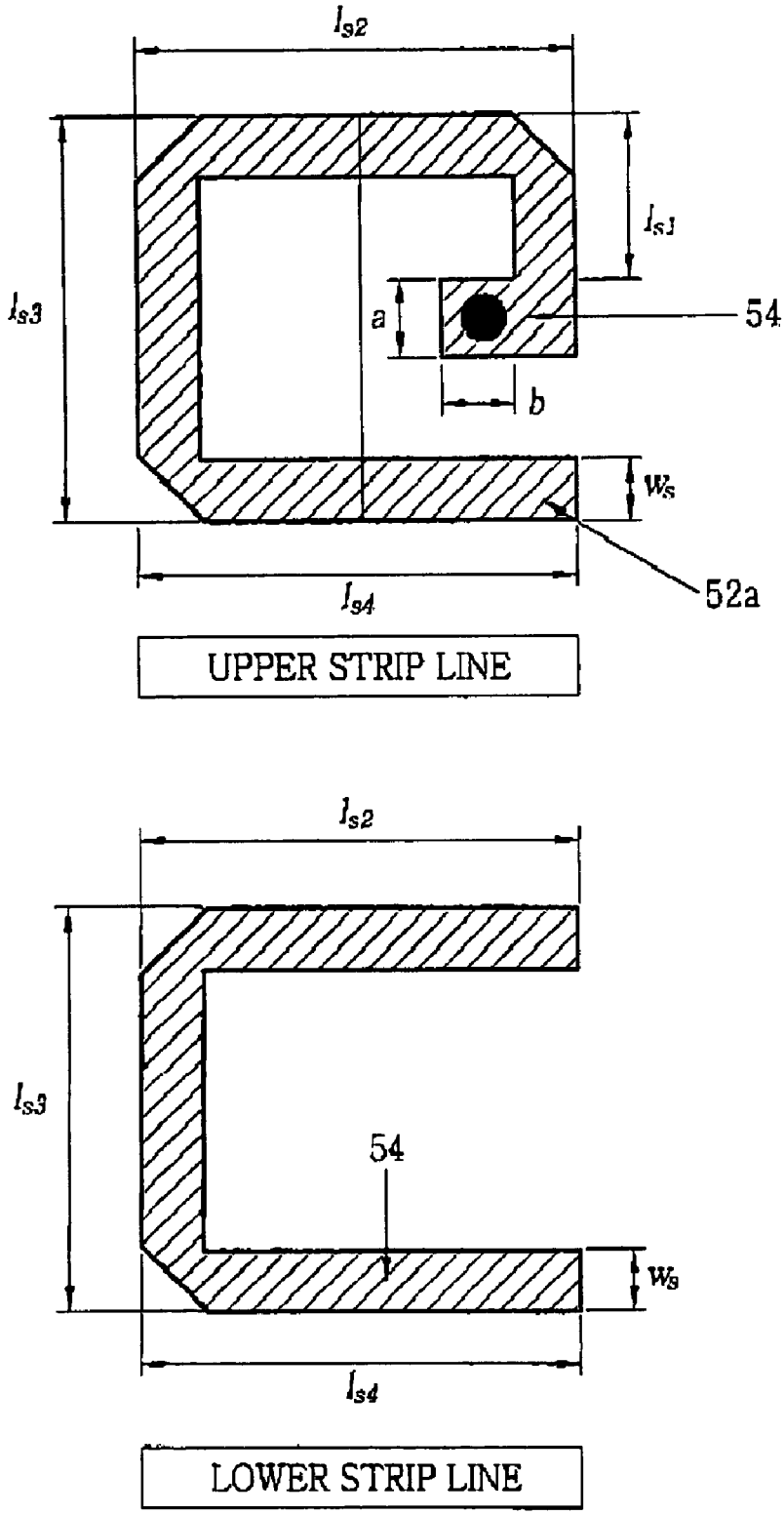

As another embodiment of the monopole antenna, a structure including a shorted patch 50 and a probe 54 with a folded strip line 52 is illustrated in FIGS. 3A, 3B, 3C, and 3D. The folded strip line 52, as illustrated in FIG. 3A, is constructed by folding a straight strip line. The folded strip line 52 consists of an upper strip line 52*a* and a lower strip line 52*b*. The upper strip line 52*a* and the lower strip line 52*b* have a width of $w_s$ and are connected by a part of strip line to have a vertical height $h_{f2}$.

Figure 3C:
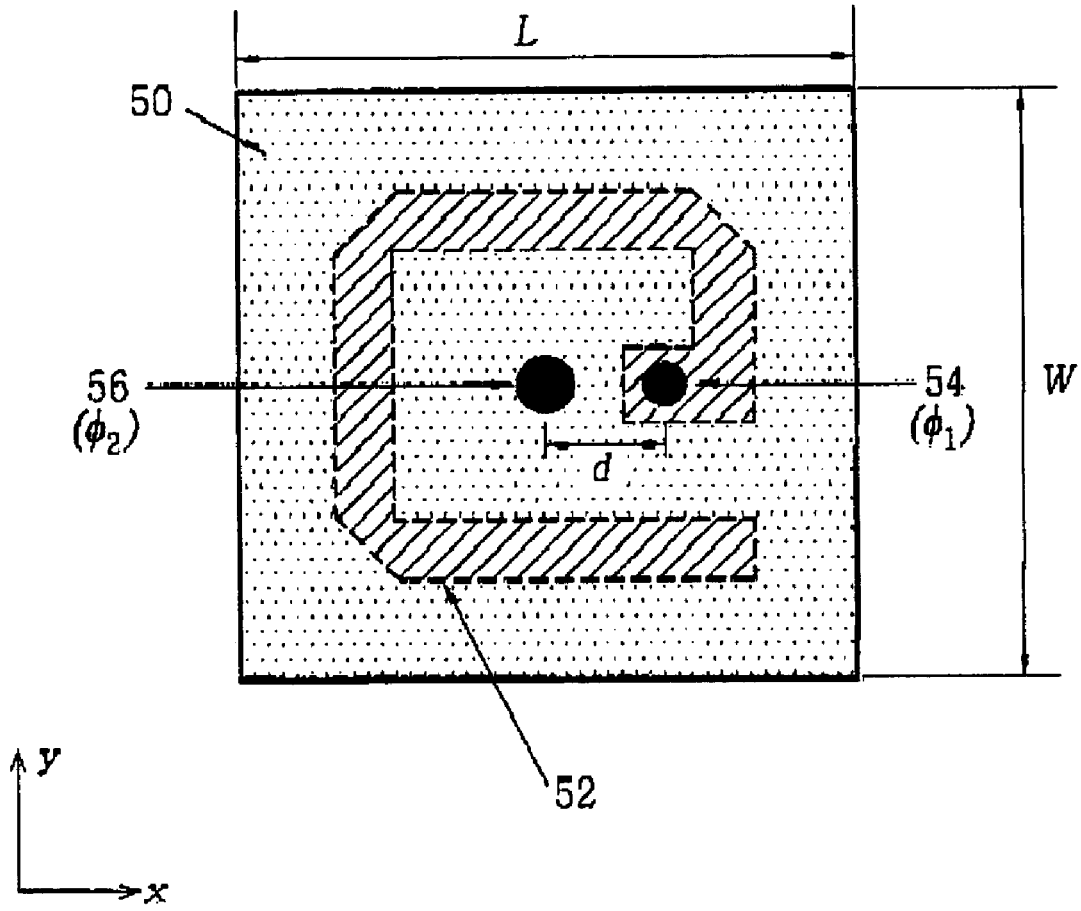
Figure 3D:
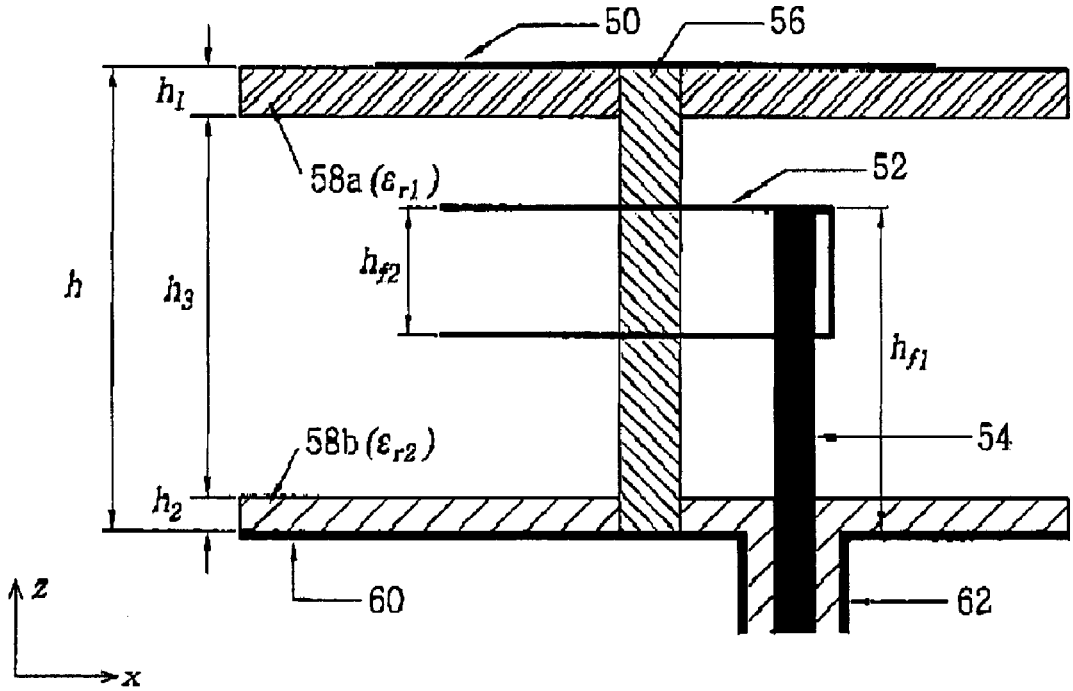

The probe 54 has a of diameter $\Phi_1$ at a height $h_f$ from a ground plane 20. The sum of the total length of folded strip line 52 and the probe height $h_{f1}$ from a ground plane 60 becomes about 0.25λ at the resonance frequency. FIG. 3C is a top view of the antenna in which a shorted patch 50 is electromagnetically coupled to the probe 54 with a folded strip line 52. Preferably, the shorted patch 50 is a rectangular patch of a length L and a width W. The shorted patch 50 has a height h from the ground plane 60 and its center is connected to the ground plane 60 via the shorting pin 56 of a diameter $\Phi_2$. The distance between the shorting pin 56 and a vertical probe 54 is d. Similar to foregoing embodiments, a dielectric substrate 58*a* of a high permittivity may be added to the lower surface of the rectangular shorted patch 50 and a dielectric substrate 58*b* may be added on the ground plane 60.

The antennas of above-described embodiments of the present invention have a common structure in that the probe with a strip line, which functions as a series RLC resonance circuit, and the shorted patch, which functions as a parallel RLC resonance circuit, are electromagnetically coupled to have the same principle of operation.

Herein below, design schemes and characteristics of the monopole antenna according to the present invention are described. Electromagnetic (EM) simulation for designing an antenna was performed with the equipment IE3D made by the Zeland Company. RT Duroid 6010 substrate was used as the dielectric substrate 18*a* applied beneath the patch 10, where the relative permittivity $\epsilon_{r1}$ and the thickness $h_1$ of the dielectric substrate 18*a* were $\epsilon_{r1}$=10.2 and $h_1$=1.27 mm, respectively. The RT Duroid 4003 substrate was used as the dielectric substrate 18*b* applied on the ground plane 20, where the relative permittivity $\epsilon_{r2}$ and the thickness $h_2$ of the dielectric substrate 18*b* were $\epsilon_{r2}$=3.38 and $h_2$=0.813 mm, respectively. The simulation was carried on an infinite-ground plane. The advanced design system (ADS) equipment made by the Agilent Company was used for the simulation to realize an equivalent circuit model of the antenna.

Figure 1C:
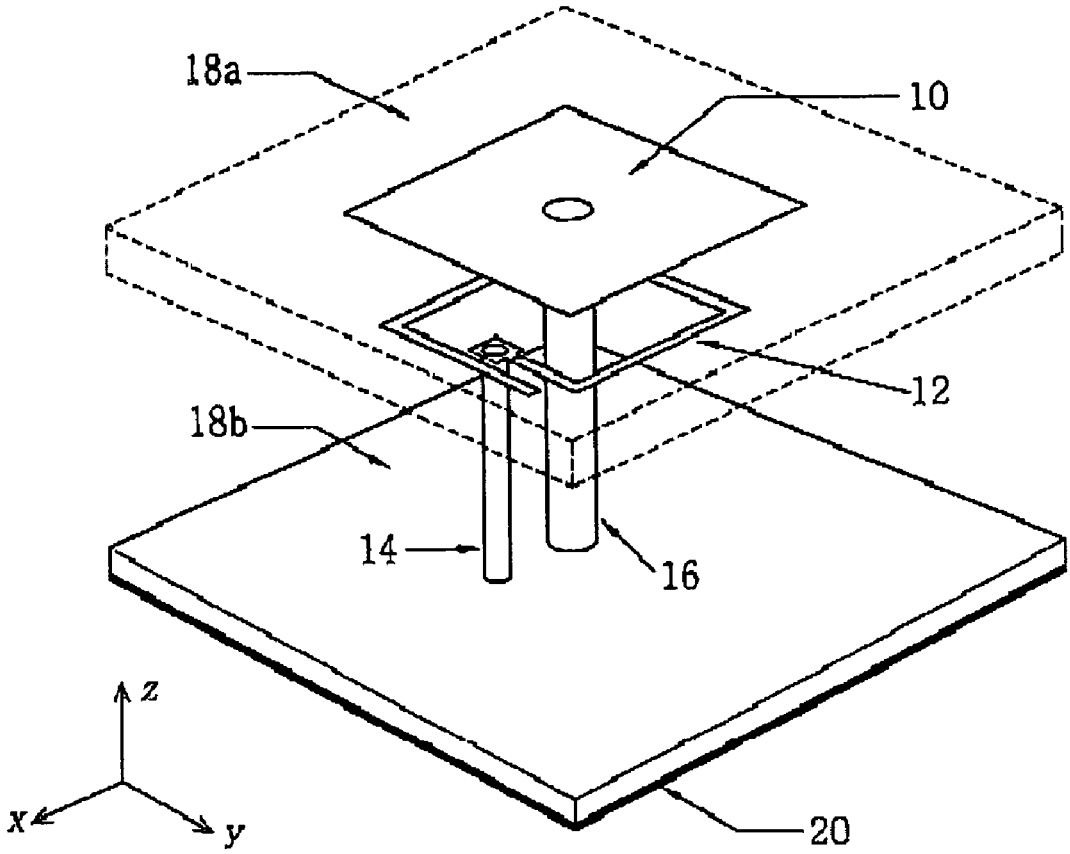
Figure 4:
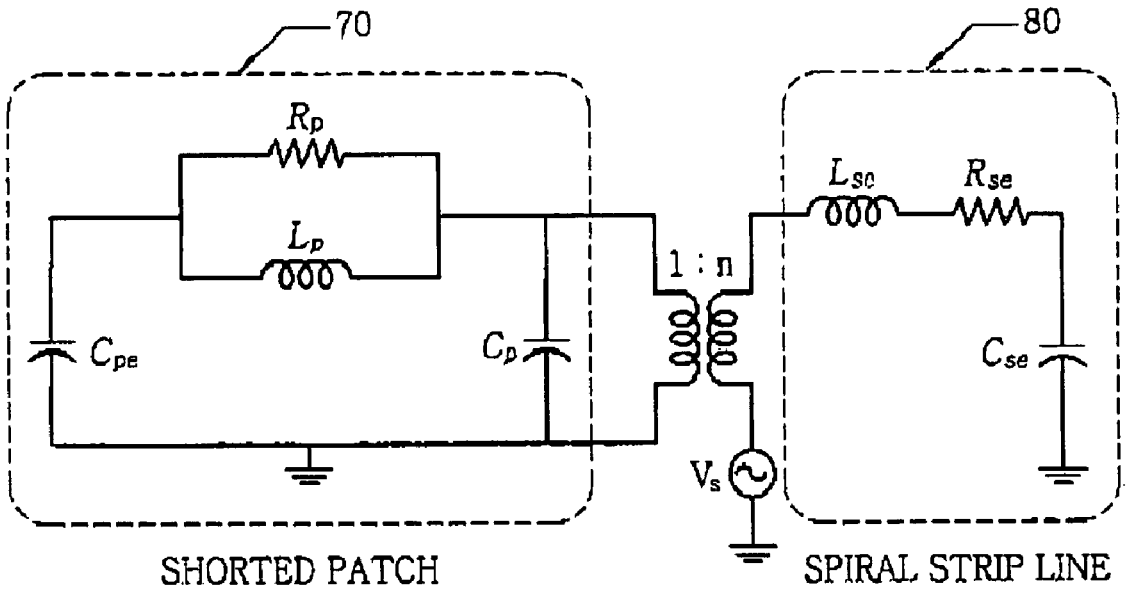
FIG. 4 is an equivalent circuit of an antenna according to the present invention.

The antenna structure illustrated in FIGS. 1A to C can be represented as an equivalent model illustrated in FIG. 4. In the antenna, the probe with a spiral strip line 12 or 80 operates as a monopole antenna of λ/4 and can be modeled into an equivalent circuit of series RLC resonance circuit. Assuming that the rectangular spiral strip line 12 or 80 is a straight strip line, an initial design value of inductance $L_{strip}$ (nH) of the strip line can be obtained as shown in Equations (1) and (2). Detailed explanations on the following equations are described in "C. S. Walker, *Capacitance, Inductance, and Crosstalk Analysis*, Boston: Artech House Inc., 1990".

$$L_{strip} = 2\times10^{-1}\times l_s\times\left[\ln\left(\frac{l_s}{w_s}\right)+1.193+0.2235\left(\frac{w_s}{l_s}\right)\right]\times K_g \quad (1)$$

$$K_g = 0.57-0.145\times\ln\left(\frac{w_s}{h_f}\right) \quad (2)$$

In Equations (1) and (2), $w_s$ and $l_s$ are width and total length of the rectangular spiral strip line 12, respectively. In addition, $K_g$ represents a correction factor and $h_f$ represents the height of the strip line 12 from the ground plane. Assuming that the probe is a column made with a conductor such as a conductor pin, an inductance $L_{probe}$ (nH) of the probe 14 can be calculated as shown in Equations (3) and (4). For more specific details on Equations (3) and (4), please refer to the descriptions in "M. E. Goldfard and R. A. Pucel, 'Modeling Via Hole Grounds in Microstrip', *IEEE Microwave Guided Wave Lett.*, vol. 1, no. 6, pp. 135–137, June 1991".

$$L_{probe} = \frac{\mu_0\times10^6}{2\pi}\left[h_f\times\ln\left(\frac{h_f+\sqrt{(\Phi_1/2)^2+h_f^2}}{(\Phi_1/2)}\right)+\frac{3}{2}\left((\Phi_1/2)-\sqrt{(\Phi_1/2)^2+h_f^2}\right)\right] \quad (3)$$

$$L_{se} = L_{strip}+L_{probe} \quad (4)$$

In Equations (3) and (4), $\Phi_1$ represents the diameter of the probe 14 and $h_f$ represents the height of the probe 14. Therefore, the total inductance $L_{se}$ of the probe 14 and the spiral strip line 12 can be represented as the sum of $L_{strip}$ and $L_{probe}$.

The shorted patch 10 or 70, as a monopole antenna of a capacitive component being coupled to the probe 14 with a strip line 12, operates as a parallel RLC resonance circuit. The inductance of the shorting pin 16 can be calculated by Equation (3). Assuming that the space between the shorted patch 10 and the ground plane 20 is a free space with the permittivity of $\epsilon_r$=1, the initial design values for the capacitance $C_p$ (pF) of the patch 10 in the parallel RLC resonance circuit and the capacitance $C_{pe}$ (pF) of external of the patch 10 can be acquired by using the Equations (5) and (6). For details on these equations, please refer to "C. H. Friedman, 'Wide-band matching of a small disk-loaded monopole', *IEEE Trans. Antennas Propagat.*, vol. AP-33, No. 10, pp. 1142–1148. October 1985." and "H. Foltz, J. S. McLean, and L. Bonder, 'Closed-Form Lumped Element Models for Folded, Disk-Loaded Monopoles', *IEEE AP-S Int. Symp.*, pp. 576–579, vol. 1, 2002".

$$C_p = \varepsilon_0\left(\frac{L+W}{4}\right)^2\pi/h \quad (5)$$

$$C_{pe} = \varepsilon_0\left(\frac{L+W}{4}\right)\times\left[8+\frac{2}{3}\ln\left\{\frac{1+0.8((L+W)/4h)^2+0.31((L+W)/4h)^4}{}\right\}\right] \quad (6)$$

Initial design values of the series inductance of the probe with a spiral strip line 12 can be determined from Equation (4) and the parallel capacitance of the shorted patch 10 can be determined from Equations (5) and (6). However, the initial designing equations leave some matters, e.g., variation of the permittivity between the patch 10 and the ground plane 20, and a coupling effect between the probe with a spiral strip line 12 and the shorted patch 10, out of consideration. Therefore, it may be difficult to determine a precise result from only these equations and accordingly optimization through a number of simulations is needed.

The antenna structures illustrated in FIGS. 2A–2B and 3A–3D follow the same operation principle with that of the antenna structures illustrated in FIGS. 1A–1C and thus, have a common equivalent circuit. In the foregoing embodiments of the present invention, the total length of the probe and the strip line is about 0.25λ in accordance with a design scheme of the antenna. A preferable design characteristic can be obtained when the length is determined within about 0.24λ~0.26λ. It should be noted, however, that an ideal value of the length is 0.25λ.

Figure 5:
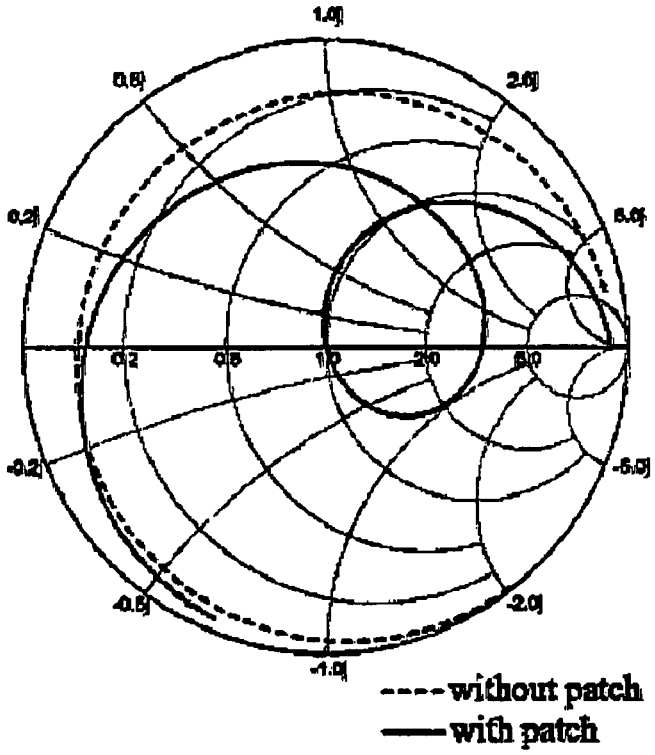
FIG. 5 illustrates impedance characteristics of a monopole antenna including a shorted patch and a probe with a spiral strip line.

FIG. 5 illustrates impedance characteristics of a monopole antenna including a shorted patch and a probe with a spiral strip line. In FIG. 5, impedance characteristics of the antenna illustrated in FIGS. 1A–1C, i.e., including a probe with a rectangular spiral strip line 12 only, and impedance characteristics of the antenna with the shorted patch 10 that is coupled to the probe 14 with a spiral strip line 12 are illustrated. In FIG. 1A, the length $l_s$ of the rectangular spiral strip line 12 is $l_s$=37.2 mm, the height $h_f$ of the probe 14 is $h_f$=7.5 mm. The shorted patch 10 has a dimension of length L=11.0 mm, width W=11.0 mm, and height h=11.0 mm and the probe 14 and the shorting pin 16 have a diameter $\Phi_1$ of 0.86 mm and a diameter $\Phi_2$ of 1.6 mm. Distance d between the probe 14 and the shorting pin 16 is d=3.6 mm. The probe 14 with a rectangular spiral strip line 12 functions as a monopole antenna of which resonance frequency is 2.0 GHz. From impedance variation of the probe with a rectangular spiral strip line 12 represented with a solid line, it can be known that even though it is possible to reduce the dimension of the monopole antenna structure, because it can have the maximum physical resonance length within the minimum volume by making the strip line into a spiral shape, the resonance characteristics of the probe with a spiral strip line itself may not acceptable because a radiation resistance is decreased due to the low height of the probe as compared to the wavelength of the resonance frequency.

From an observation on the impedance variation, when the shorted patch 10 is added to the probe with a rectangular spiral strip line 12, the series resonance of the probe with a spiral strip line 12 and the parallel resonance of the shorted patch 10, which are combined with each other to produce a double-resonance, can be determined. That is, in the resonance of a spiral strip line, the loop of the impedance locus is largely rotated one time, to thereby produce a single-resonance. However, as described above, when the resonance of the shorted patch and the resonance of a spiral strip line are combined, a double-resonance is produced, which shows in the form of a loop of a small circular locus as shown in FIG. 5. Such a form is called a double resonance.

Figure 6:
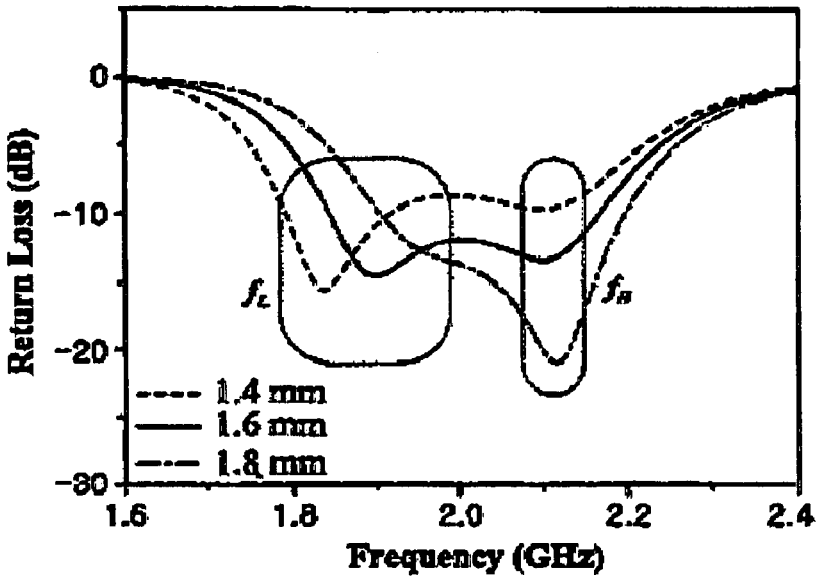
FIG. 6 illustrates variation of return loss with shorting pin diameter.

FIG. 6 illustrates variations of return loss with the diameter of the shorting pin 16 illustrated in FIG. 1A, while all other design parameters are fixed. As the diameter of the shorting pin 16 increases in turn of 1.4 mm, 1.6 mm and 1.8 mm, a low resonance frequency $f_L$ moves from 1.83 GHz to 1.95 GHz and a high resonance frequency $f_H$ is kept around 2.1 GHz. The shorted patch 10 and the probe with a spiral strip line have the resonance frequencies of $f_L$ and $f_H$, respectively. As the diameter of the shorting pin 16 for the patch 10 increases, the capacitance in the shorted patch decreases. Therefore the resonance frequency of the shorted patch 10 increases and thus, the resonance frequency $f_L$ of the shorted patch 10 is shifted into a higher frequency.

Figure 7:
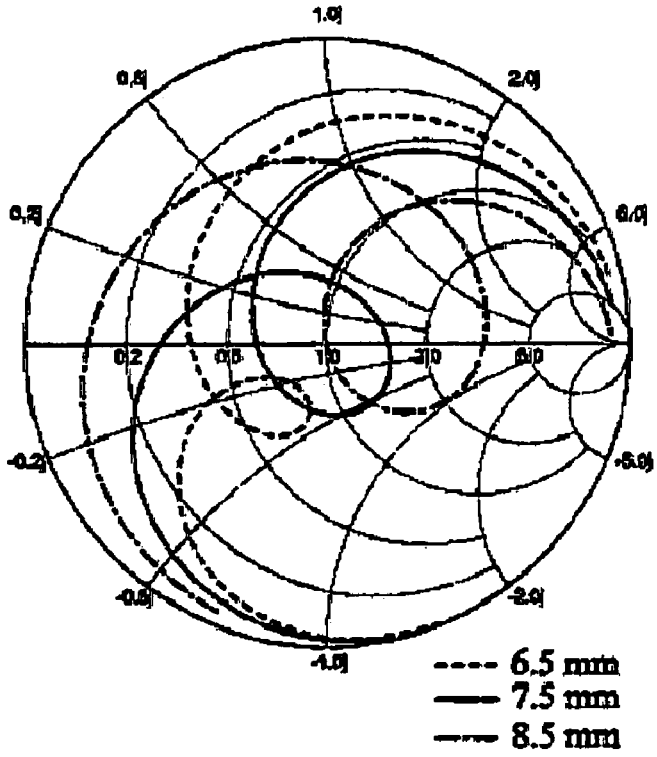
FIG. 7 illustrates variations of impedance with the height of probe.

FIG. 7 illustrates variations of impedance of the antenna with the change of the height of the probe, which is connected to the spiral strip line 12, illustrated in FIG. 1A. All other parameters are fixed. If the height $h_f$ of the probe 14, where the spiral strip line 12 is connected, is raised from 6.5 mm to 8.5 mm, the inductance of the probe increases. In addition, the coupling area between the shorting pin 16 and the probe 14 increases and the distance between the shorted patch 10 and the spiral strip line 12 is shortened. Therefore, the coupling of the shorted patch 10 and the probe with a spiral strip line 12 becomes enhanced. In the result, the loop of the impedance locus enlarges and moves upwards on the Smith chart as the height of the probe increases.

Figure 8:
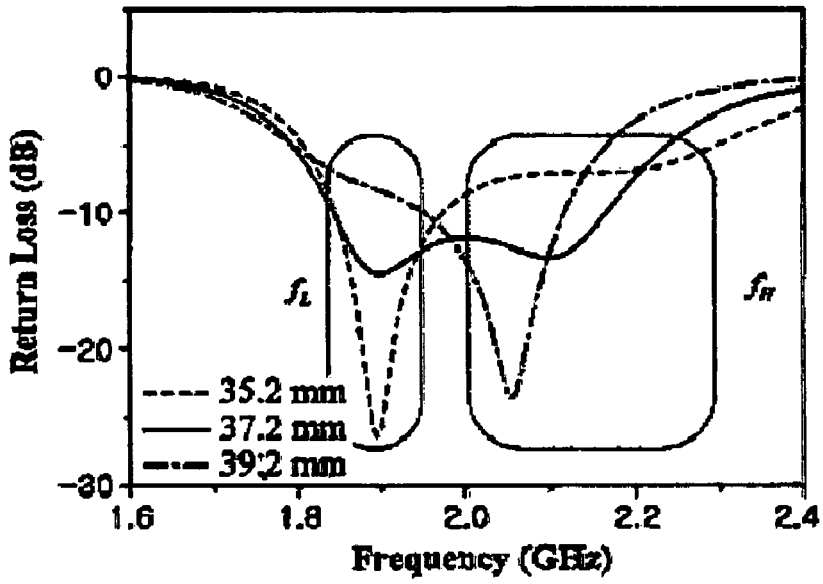
FIG. 8 illustrates variations of return loss with the spiral strip line length.

FIG. 8 illustrates return losses of an antenna with the change of the length of the rectangular spiral strip line 12 illustrated in FIG. 1A. When all other parameters are the same as the previous case, the length $l_s$ of the spiral strip line 12 is changed from 35.2 mm to 39.2 mm. As a result, by increasing the length of the spiral strip line 12, its inductance also increases and the resonance frequency $f_H$ decreases from 2.19 GHz to 2.05.

As illustrated in FIGS. 6, 7, and 8, the resonance frequencies $f_L$ and $f_H$ can be adjusted by varying design parameters of the shorted patch 10 and the probe 14 with a spiral strip line 12 to change the inductance and the capacitance. It should be noted that a wide single-band can be obtained by positioning the resonance frequency of the spiral strip line 12 and the resonance frequency of the shorted patch 10 nearer with each other, while a dual-band can be obtained by positioning the two resonance frequencies at different positions with each other (farther apart).

Figure 9A:
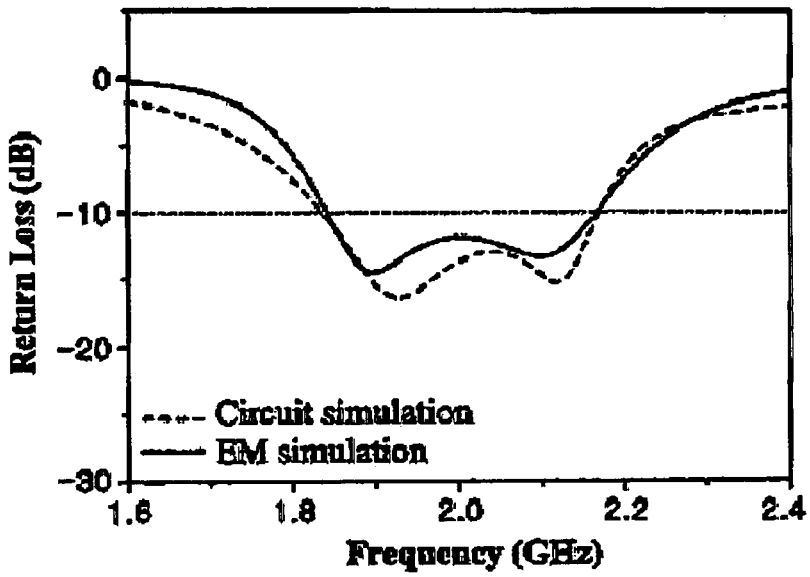
FIGS. 9A and 9B illustrate return loss and variation of impedance characteristics, which are obtained by using the equivalent circuit and EM simulation, respectively.
Figure 9B:
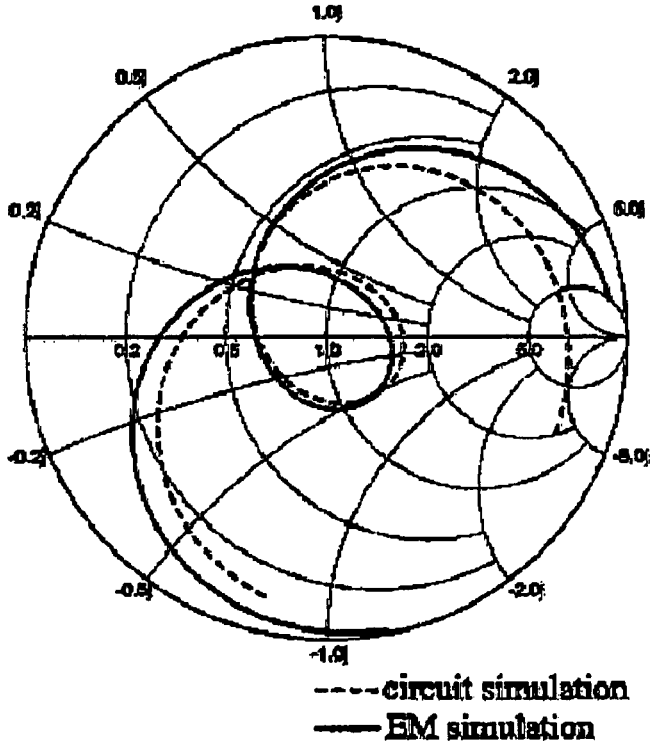

In FIGS. 9A and 9B, return loss and impedance variation of an optimized antenna are illustrated, which are obtained from an equivalent circuit and EM simulation for the antenna illustrated in FIGS. 1A~1C. Table 1 shows examples of the design parameters of the optimized antenna.

Referring to FIGS. 9A and 9B, when a calculation result by the equivalent circuit is compared with EM simulation, it can be seen that the two calculated values are similar with each other. In the EM simulation, the antenna has a bandwidth from 1.835 GHz to 2.17 GHz, which is about 16.5% with respect to Voltage Standing Wave Ratio (VSWR)≦2.

TABLE 1

Exemplary design parameters of the monopole antenna including a rectangular shorted-patch and a probe with a rectangular spiral strip line

| | Design parameters | Length (mm) |
|---|---|---|
| Probe with a rectangular spiral strip line | $l_s$ | 37.2 |
| | $w_s$ | 0.5 |
| | a | 1.3 |
| | b | 1.3 |
| | d | 3.6 |
| | $h_f$ | 7.5 |
| | $\phi_1$ | 0.86 |
| Rectangular shorted patch | L | 11.0 |
| | W | 11.0 |
| | h | 11.0 |
| | $h_1$ | 1.27 |
| | $h_2$ | 0.813 |
| | $h_3$ | 8.917 |
| | $\phi_2$ | 1.6 |

Figure 10A:
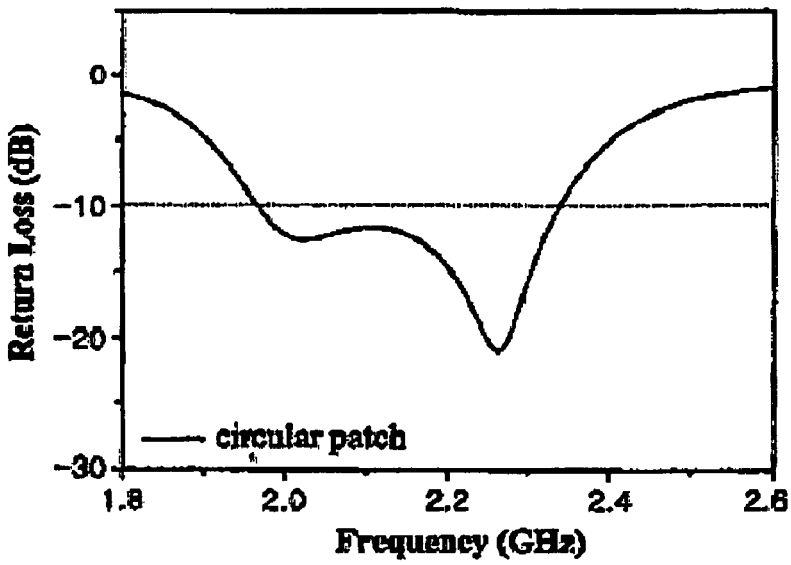
FIGS. 10A and 10B illustrate return loss and variation of impedance characteristics of a monopole antenna including a shorted patch and a probe with a circular spiral strip line.
Figure 10B:
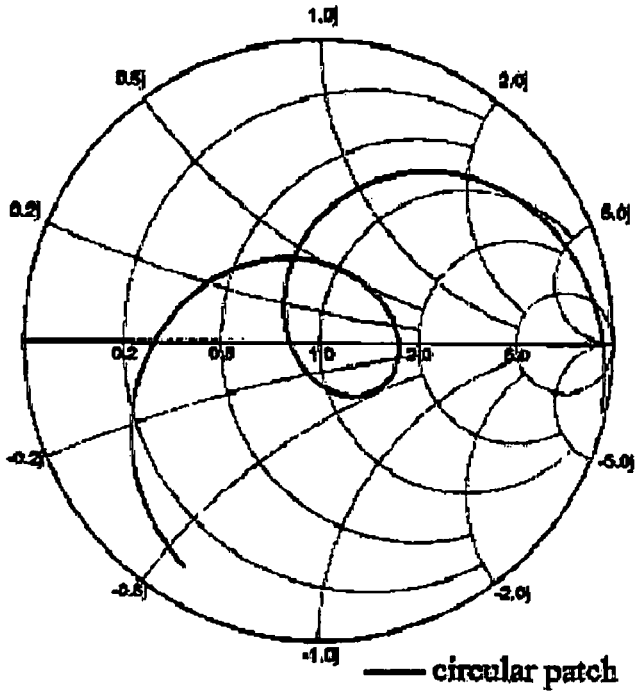

FIGS. 10A and 10B illustrate variations of impedance and return loss, which are obtained by an EM simulation, of an optimized antenna as illustrated in FIGS. 2A and 2B. Table 2 illustrates examples of design parameters for an optimized antenna. In the return loss illustrated in FIG. 10A, the antenna has a 17.4% bandwidth from 1.965 GHz to 2.34 GHz with respect to VSWR≦2. FIG. 10B illustrates the impedance variation in a Smith chart. From comparisons between the graphs illustrated in FIGS. 9A–9B and the graphs illustrated in FIGS. 10A–10B, it can be known that the antenna with the circular patch and the circular spiral strip line has a similar characteristics as the antenna with the rectangular patch and the rectangular spiral strip line.

TABLE 2

Exemplary design parameters of the monopole antenna including a circular shorted-patch and a probe with a circular spiral strip line

| | Design parameters | Length (mm) |
|---|---|---|
| Probe with a circular spiral strip line | $l_s$ | 31.5 |
| | $w_s$ | 0.4 |
| | a | 1.3 |
| | b | 1.3 |
| | d | 3.4 |
| | $h_f$ | 8.0 |
| | $\phi_1$ | 0.86 |
| Circular shorted patch | $2^\rho$ | 11.0 |
| | h | 11.0 |
| | $h_1$ | 1.27 |
| | $h_2$ | 0.813 |
| | $h_3$ | 8.917 |
| | $\phi_2$ | 1.6 |

Figure 11A:
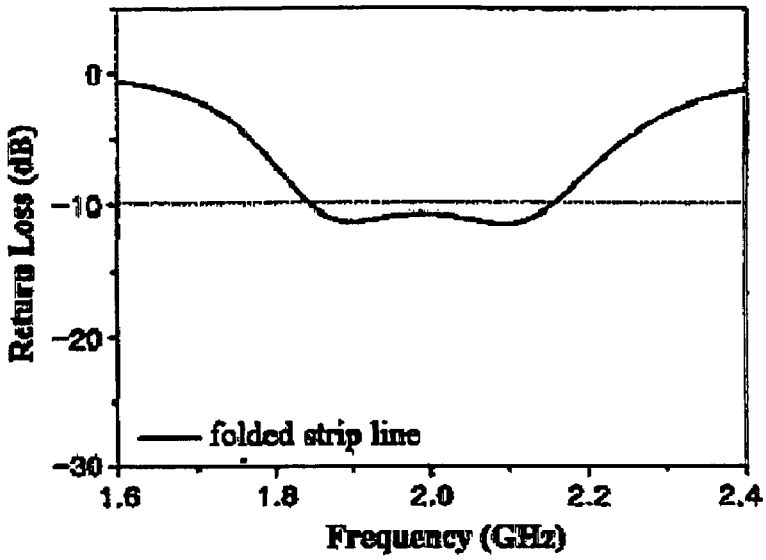
FIGS. 11A and 11B illustrate the return loss and variation of impedance characteristics of a monopole antenna including a shorted patch and a probe with a folded strip line.
Figure 11B:
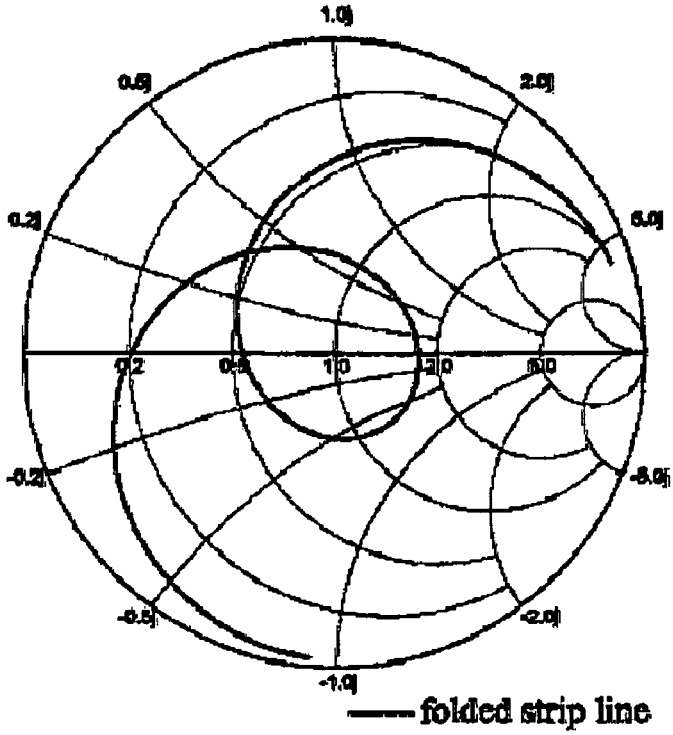
Figure 12A:
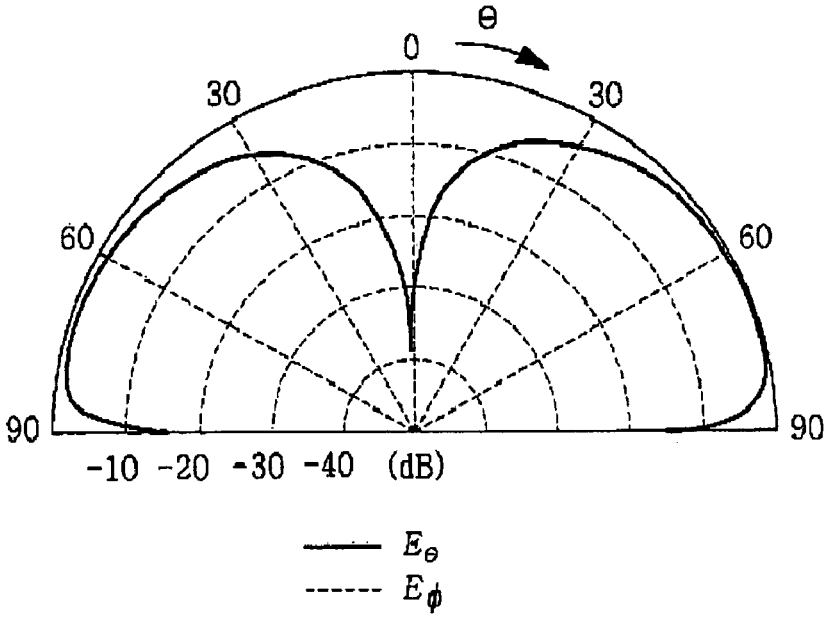
FIGS. 12A and 12B illustrate calculated antenna radiation patterns at 1.95 GHz in x-z plane and y-z plane, respectively.
Figure 12B:
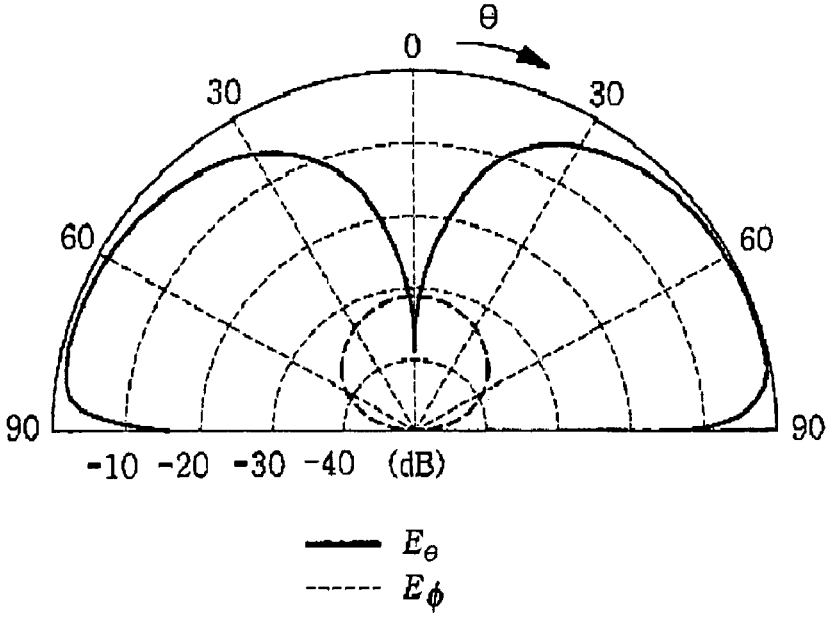
Figure 13A:
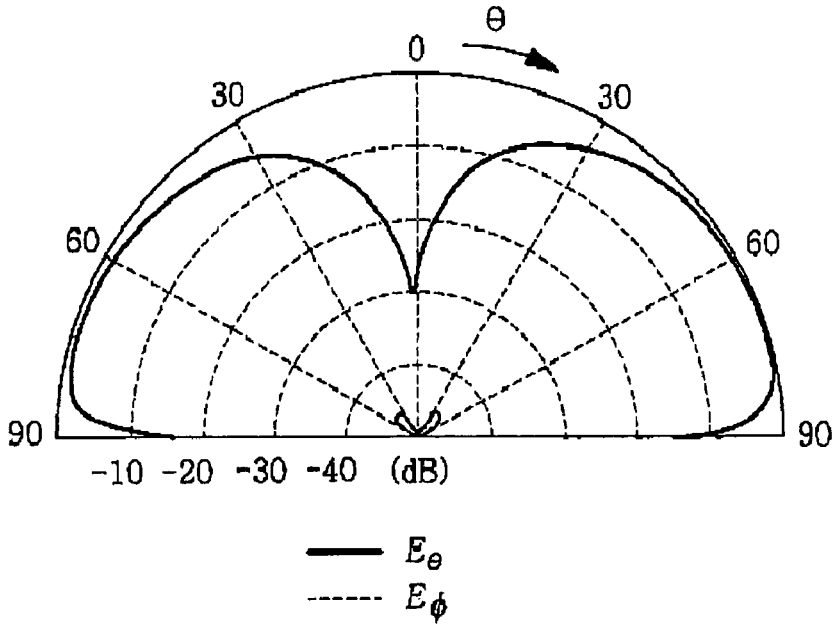
FIGS. 13A and 13B illustrate calculated antenna radiation patterns at 2.1 GHz in x-z plane and y-z plane, respectively.
Figure 13B:
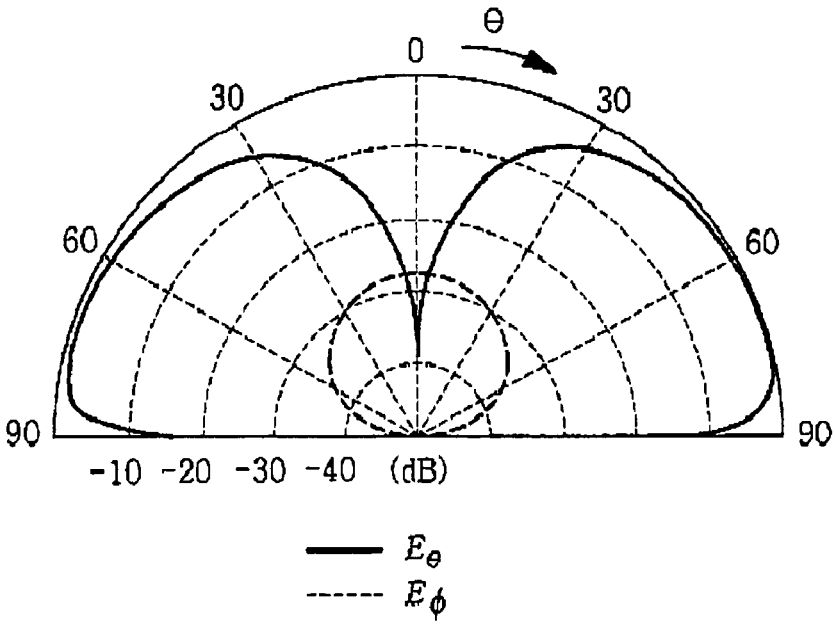

FIG. 11 illustrates variations of impedance and the return loss of an optimized antenna acquired from the EM simulation with respect to the folded strip line illustrated in FIG. 3A. Table 3 illustrates examples of the design parameters of the optimized antenna. In the return loss illustrated in FIG. 11A, the antenna has a 16.5% bandwidth from 1.835 GHz to 2.165 GHz with respect to VSWR≦2. FIG. 11B illustrates the impedance variation in a Smith chart. Accordingly, the folded strip line antenna has a similar characteristic with the rectangular spiral strip line antenna.

TABLE 3

Exemplary design parameters of the monopole antenna including a rectangular shorted-patch and a folded strip line

| | Design Parameters | Length (mm) |
|---|---|---|
| Probe with a folded strip line | $l_{s1}$ | 6.1 |
| | $l_{s2}$ | 6.5 |
| | $l_{s3}$ | 6.2 |
| | $l_{s4}$ | 2.45 |
| | $w_s$ | 0.3 |
| | a | 1.3 |
| | b | 1.3 |
| | d | 2.6 |
| | $h_{f1}$ | 9.1 |
| | $h_{f2}$ | 1.2 |
| | $\phi_1$ | 0.86 |
| Rectangular shorted patch | L | 11.0 |
| | W | 11.0 |
| | h | 11.0 |
| | $h_1$ | 1.27 |
| | $h_2$ | 0.813 |
| | $h_3$ | 8.917 |
| | $\phi_2$ | 1.6 |

FIGS. 12A–12B and 13A–13B illustrate sectional views of radiation patterns at 1.95 GHz and 2.1 GHz, for the antenna with rectangular spiral strip line illustrated FIG. 1C, respectively, in x-z plane and y-z plane. The radiation patterns illustrated in FIGS. 12A–12B and 13A–13B illustrate that at 1.95 GHz and 2.1 GHz the antenna has a monopole type radiation pattern. In addition, the radiation pattern has a good linear polarization that the difference value between co-polarization and the cross-polarization with respect to a main beam direction is over 30 dB.

Figure 14:
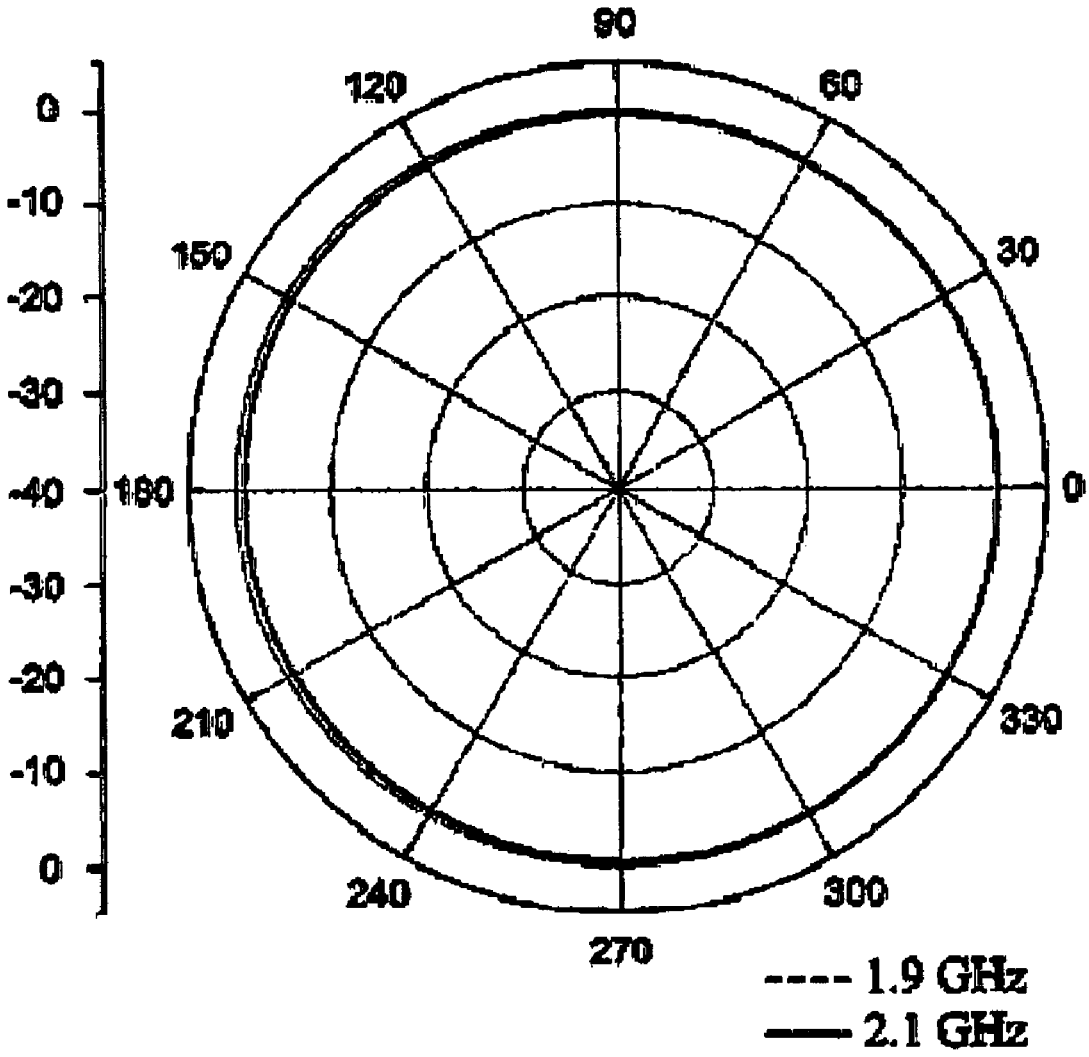
FIG. 14 illustrates a calculated antenna radiation pattern in an x-y plane.

FIG. 14 illustrates an antenna radiation pattern in an x-y plane, in a direction of main beam, at 1.95 GHz and 2.1 GHz. In FIG. 14, $E_\theta$ has omni-directional radiation pattern with respect to an antenna plane. Antenna gain in the direction of main beam has a value over 2 dBi within a bandwidth.

Hereinafter, a description will be made for several monopole antennas, which have different antenna characteristics depending on the number of shorting pins according to other embodiments of the present invention.

FIGS. 15A to 15D are views illustrating antennas having shorting pins, the number of which is different according to embodiments of the present invention. Antennas illustrated in FIGS. 15A to 15C include a rectangular patch 150 for connecting multiple shorting pins and a rectangular spiral strip line 151 to which a probe 153 is fed.

Figure 15A:
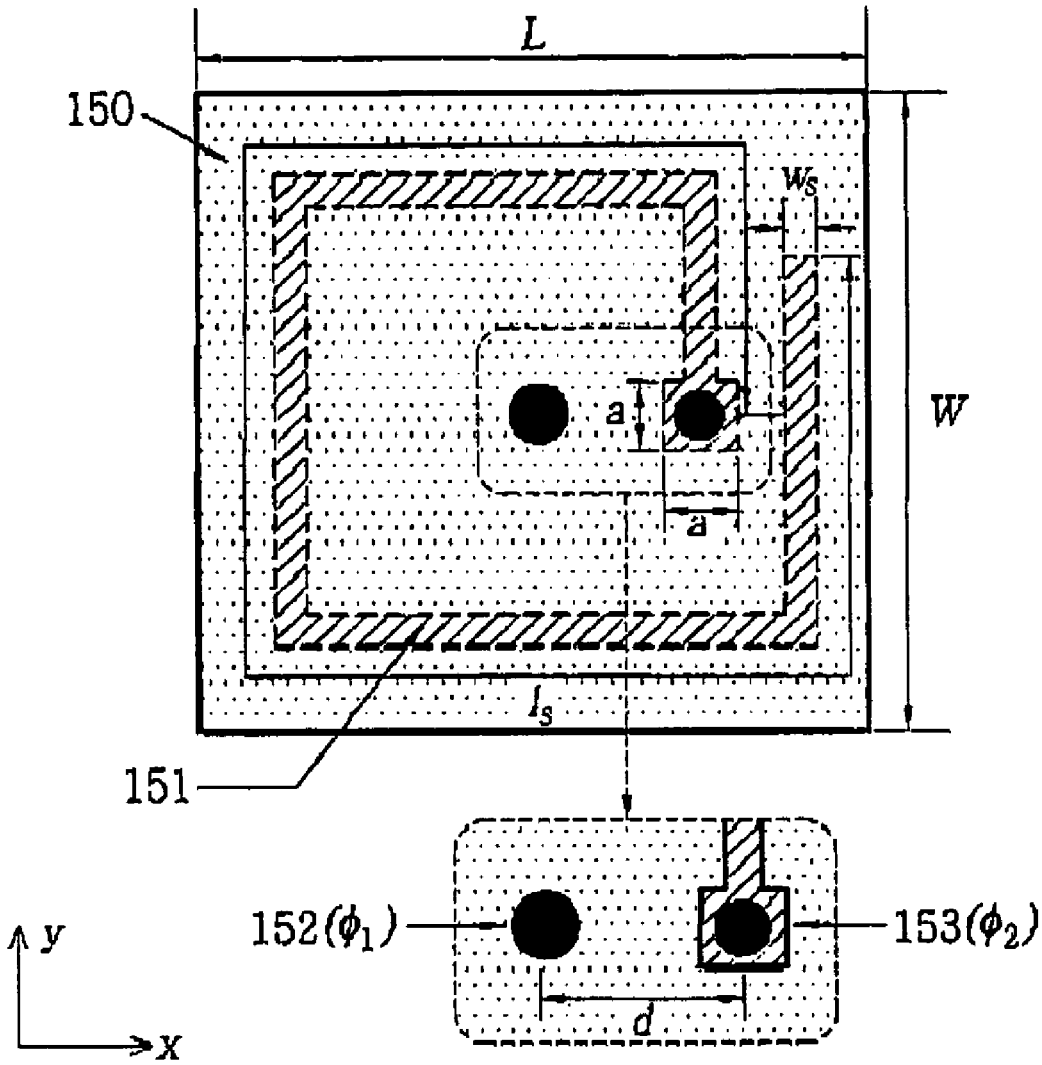
FIGS. 15A to 15D are views illustrating antennas having shorting pins, the number of which is different according to embodiments of the present invention.
Figure 15B:
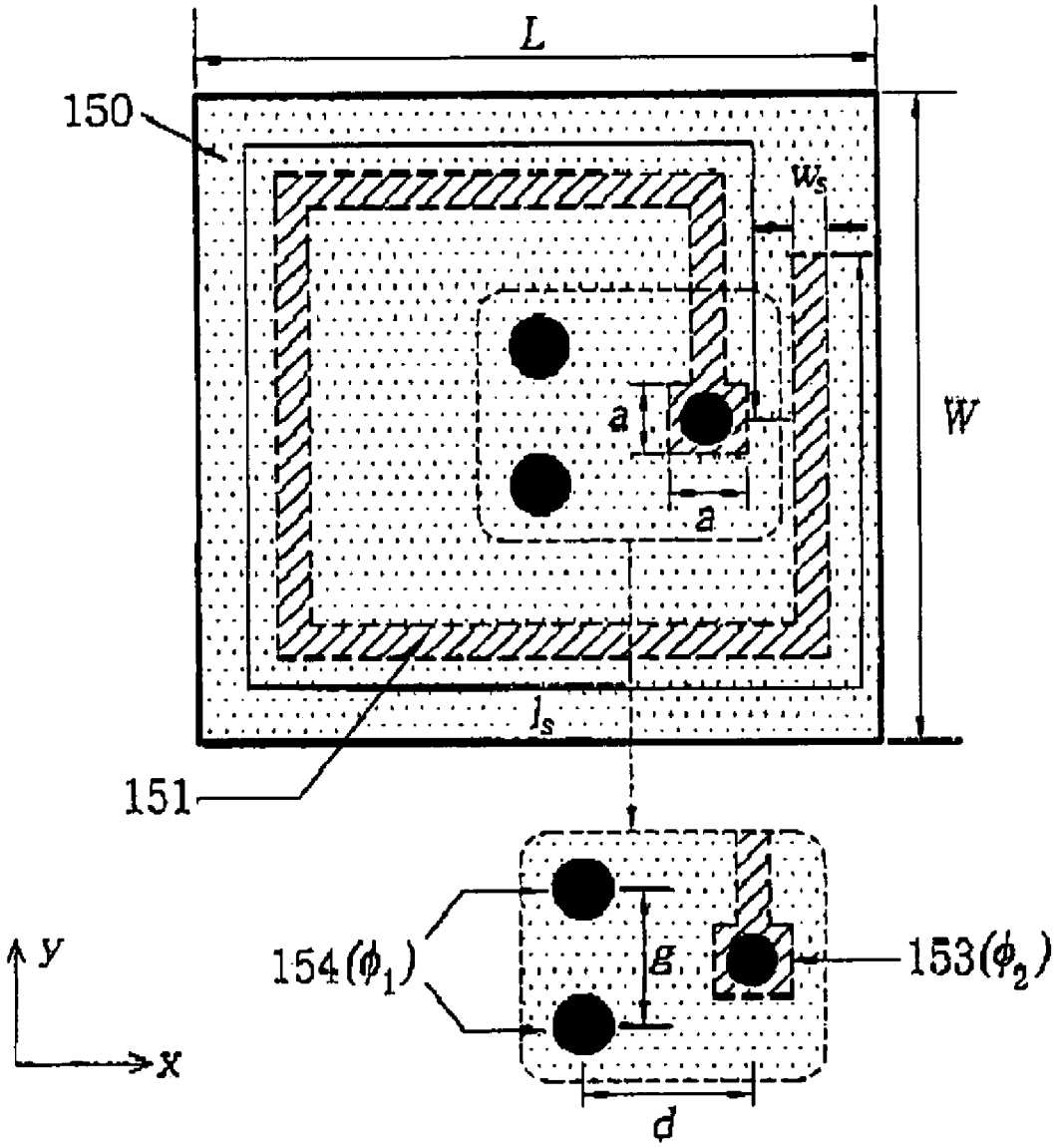
Figure 15C:
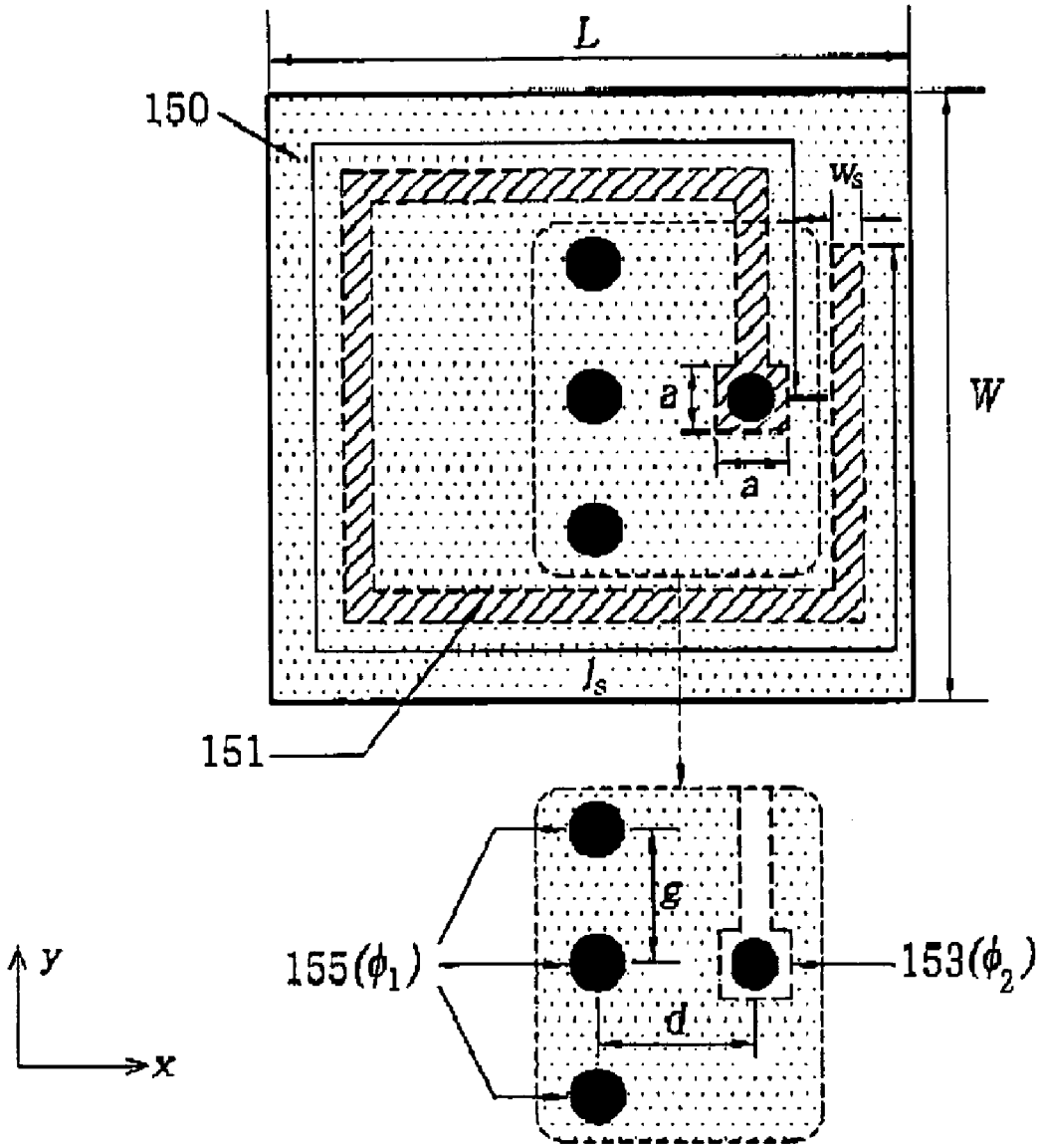
Figure 15D:
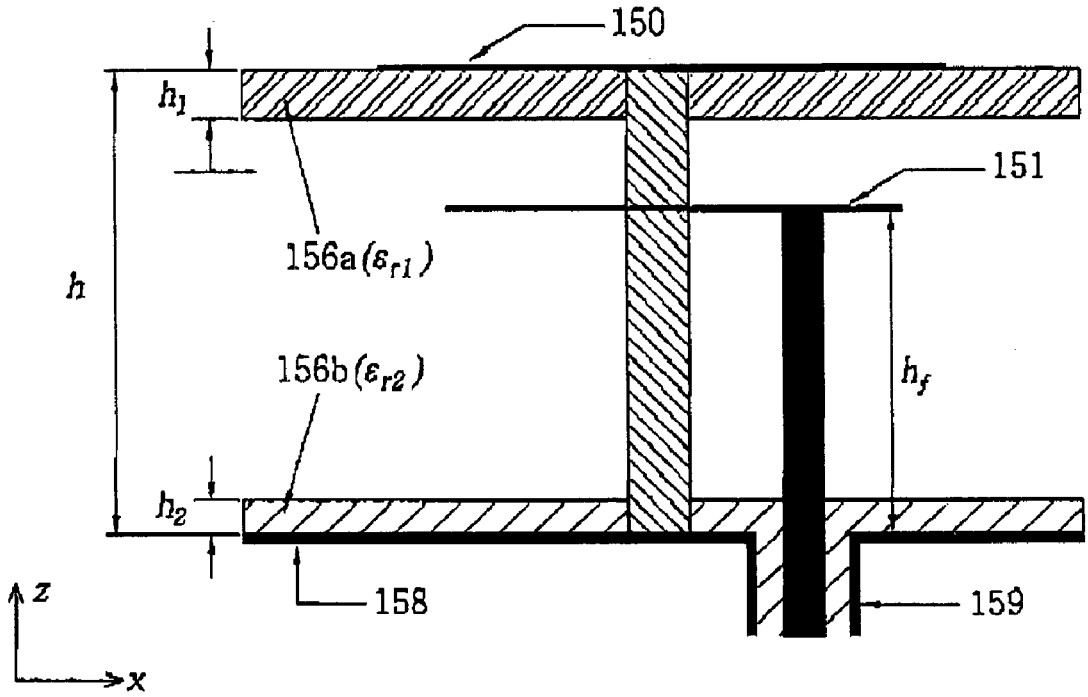

More specifically, FIGS. 15A to 15C are front views illustrating antennas in which one, two, and three shorting pins are connected to the rectangular patch 150, respectively, and FIG. 15D is a side view of an antenna according to an embodiment of the present invention. The rectangular patch 150 has a length of L and a width of W and is located at a height of h. When only a single shorting pin 152 is connected to the rectangular patch 150, the shorting pin is located at the center of the rectangular patch 150. When two or more shorting pins are connected to the rectangular patch 150, the shorting pins 154 and 155 are aligned in y-axis direction on the basis of the center of the rectangular patch 150 and are connected to a ground plane. The shorting pins have the same diameter of $\phi_1$. The multiple shorting pins are aligned in an interval of g on the rectangular patch 150.

The rectangular spiral strip line 151 has a total length of $l_s$ and a width of $w_s$, and is fed by the probe 153 having a diameter of $\phi_2$ at a height of $h_f$. Because the diameter of the probe 153 is wider than the width of the rectangular spiral strip line 151, a small square patch having sides of length a is formed at an end to connect the probe 153 to the rectangular spiral strip line 151. Each of the shorting pin 152, 154, and 155, and the probe 153 fed to rectangular spiral strip line 151 are located at positions that are separated by a length of d on the rectangular patch 150, thereby being electromagnetically coupled with each other. Similarly to the embodiment described with reference to FIGS. 1A–1C, a high permittivity dielectric substrate 156*a* is added on the lower surface of the patch 150, and a dielectric substrate 158 is added on the upper surface of the ground plane.

Hereinafter, antennas according to embodiments of the present invention will be described through simulation tests using the same data as those used in the simulation of FIGS. 1A–1C.

Figure 16A:
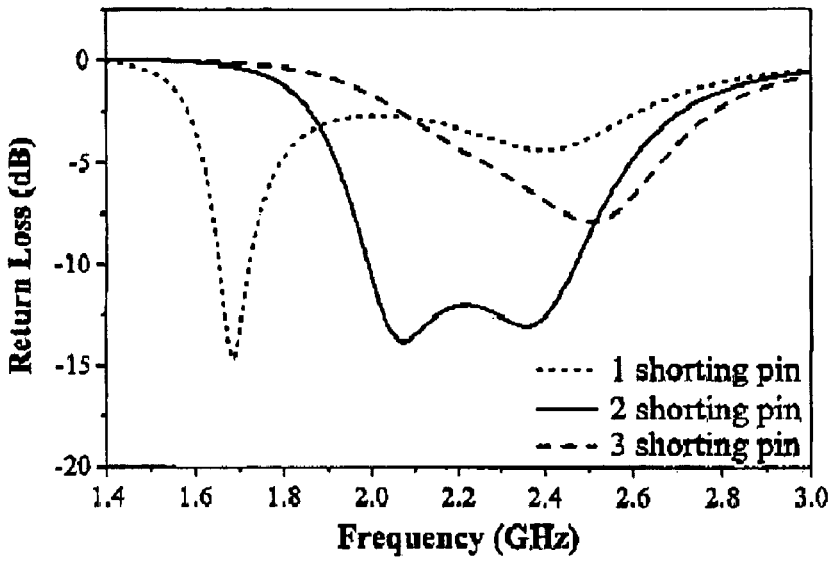
FIGS. 16A and 16B illustrate differences in impedance and return losses according to changes in a number of the shorting pins connected to the rectangular patch in an antenna according to an embodiment of the present invention.
Figure 16B:
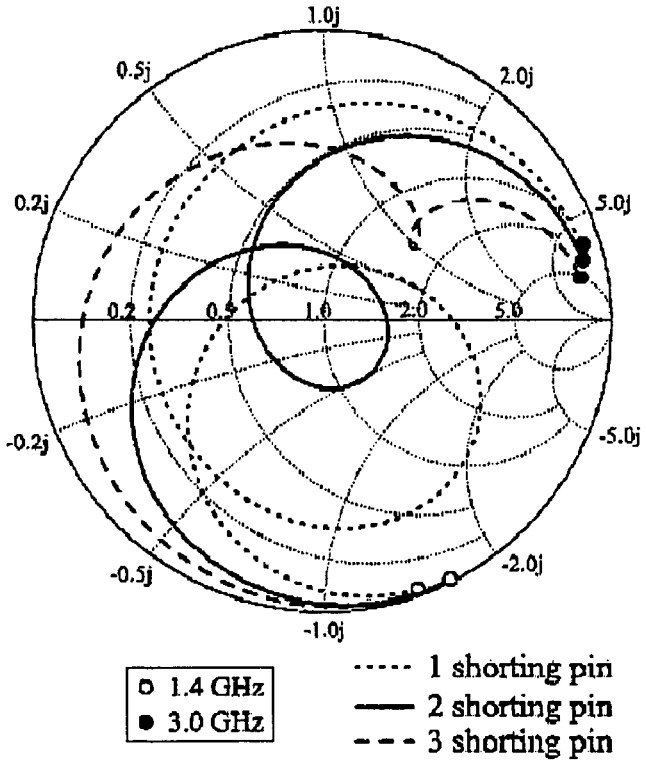

FIGS. 16A and 16B illustrate differences in impedance and return losses according to a change in the number of the shorting pins connected to the rectangular patch in an antenna according to an embodiment of the present invention. In FIGS. 16A and 16B, the rectangular patch 150 has dimensions of L=W=11.0 mm, and the shorting pin has a diameter $\phi_1$ of 1.0 mm. When only a single shorting pin is connected to the rectangular patch, the shorting pin is located at the center of the rectangular patch. When a plurality of shorting pins are connected to the rectangular patch, the shorting pins are aligned in an interval g of 3.0 mm in y-axis direction on the basis of the center of the rectangular patch. Also, the rectangular spiral strip line has a total length $l_s$ of 29.68 mm and a line width $w_s$ of 0.5 mm. The probe connected to the rectangular spiral strip line has a diameter $\phi_2$ of 0.86 mm, a height $h_f$ of 8.4 mm, and an interval d between the probe and the shorting pin is 3.9 mm.

When the number of the shorting pins increases, the area occupied by the shorting pins also increases. As a result, the capacitance of the rectangular patch decreases. Therefore, referring to return loss illustrated in FIG. 16A, when the number of the shorting pins increases from one to three, a center frequency of the antenna increases from about 1.69 GHz to 2.19 GHz, and then to 2.51 GHz.

With the increase of the center frequency, both an interval between the probe and the shorting pins and an interval between the rectangular spiral strip line and the patch become more distant electrically, such that the couplings between them decrease.

FIG. 16B is a Smith chart illustrating an impedance characteristic depending on an increase of the number of shorting pins in an antenna according to an embodiment of the present invention. Referring to FIG. 16B, it can be understood that the decrease of the capacitance resulting from the increase of the number of the shorting pins in an antenna according to an embodiment of the present invention moves the loop of an impedance locus from a capacitive region to an inductive region, and the decrease of the coupling causes the size of the loop of the impedance locus to be reduced.

As described above with reference to FIGS. 15A to 15D and FIGS. 16A and 16B, it is possible to change characteristics of the return loss and the input impedance by increasing the number of the shorting pins. Such an effect can also be obtained by changing the locations of the shorting pins, which will be described below with reference to FIGS. 17 to 19.

Figure 17:
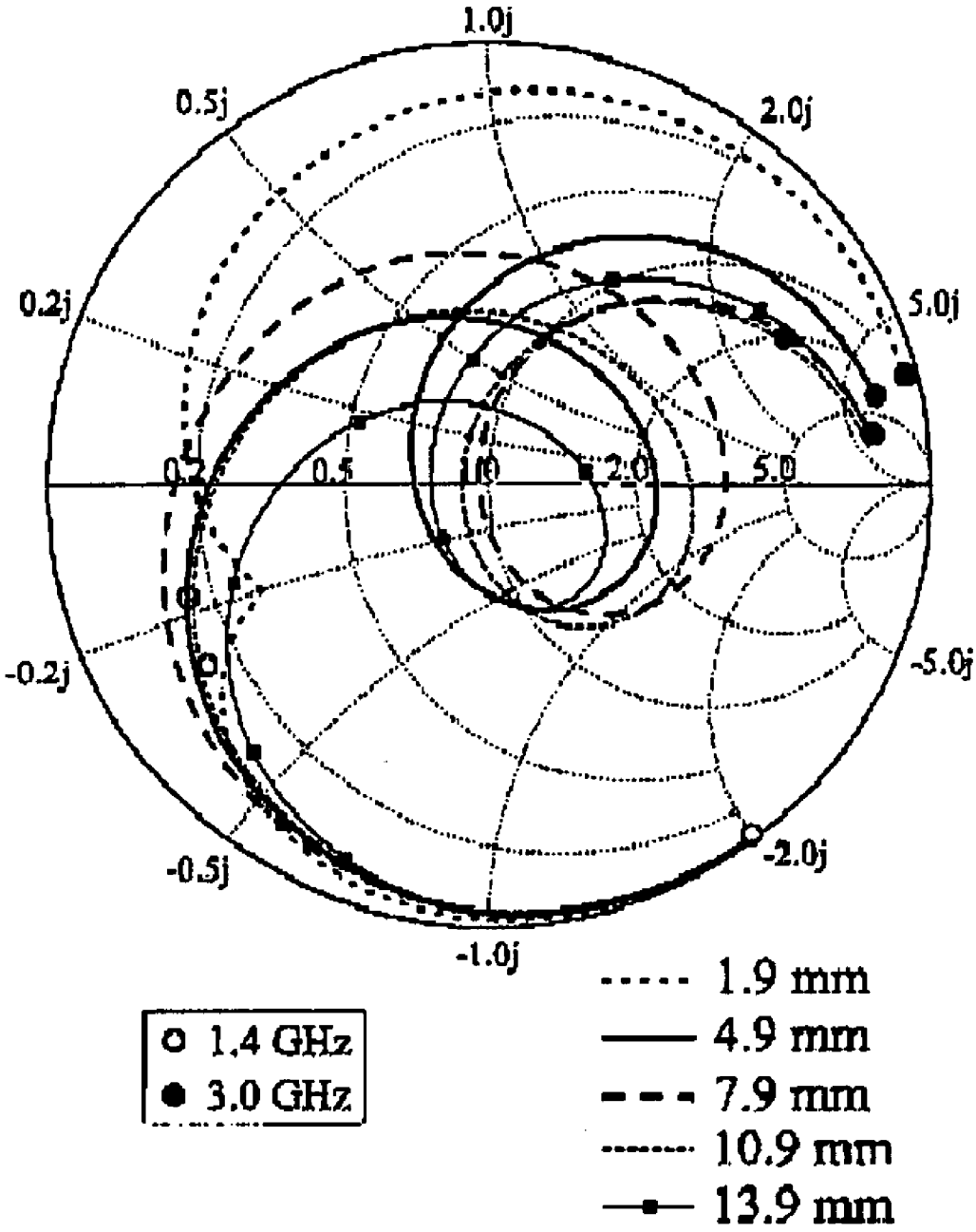
FIG. 17 is a view illustrating variations of an input impedance characteristic according to adjustments of a distance between a shorting pin and a feed probe in an antenna according to an embodiment of the present invention.

FIG. 17 is a view illustrating variations of an input impedance characteristic according to adjustments of the distance between a shorting pin and a feed probe in an antenna according to an embodiment of the present invention. That is, FIG. 17 illustrates variations of an input impedance characteristic of an antenna according to adjustments of a distance d between a shorting pin and a feed probe, when two shorting pins are aligned at an interval g of 3.0 mm in a rectangular patch. In this embodiment, the dimensions of a shorted rectangular patch and the length and height of a rectangular spiral strip line feed are established as the same values as those established in the embodiment of FIGS. 16A and 16B. The variation of the input impedance characteristic of an antenna will be described with distance d as a parameter.

Referring to FIG. 17, an electromagnetic coupling efficiency between a shorted rectangular patch and a feed probe is determined by distance d. In addition, the variation of distance d causes the input impedance of the antenna to be changed to exert an effect on bandwidth. More specifically, when distance d between a shorting pin and a probe is 1.9 mm, an electromagnetic coupling between a shorted patch monopole and a probe-fed rectangular spiral strip line monopole is very weak, such that the loop of an impedance locus is small. The more the distance between the two monopoles increases, the more the coupling between them increases. When distance d becomes 7.9 mm, the coupling is maximized to cause the loop of the impedance locus to be maximized. However, when distance d increases over 7.9 mm, the electromagnetic coupling again decreases to cause the loop of the impedance locus to be smaller and smaller as illustrated in FIG. 17, for distances d of 10.9 mm and 13.9 mm.

Therefore, an antenna can be designed to have a maximum bandwidth by changing the electromagnetic coupling through adjustment of a distance between a feed probe and a shorting pin in a rectangular patch.

Figure 18A:
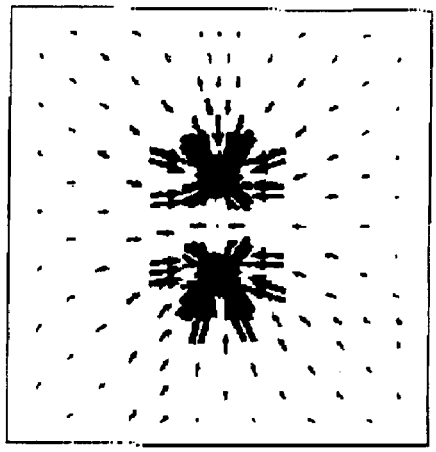
FIGS. 18A to 18C are views illustrating electric current distributions depending on the adjustment of a distance between shorting pins in an antenna having two shorting pins according to an embodiment of the present invention.
Figure 18B:
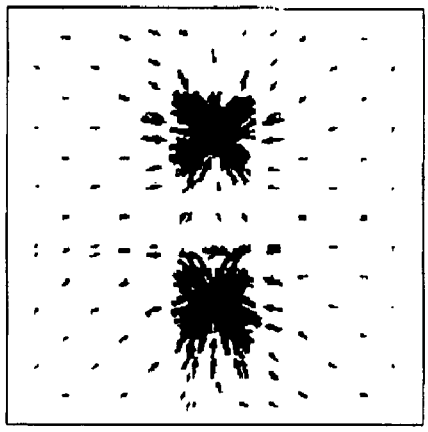
Figure 18C:
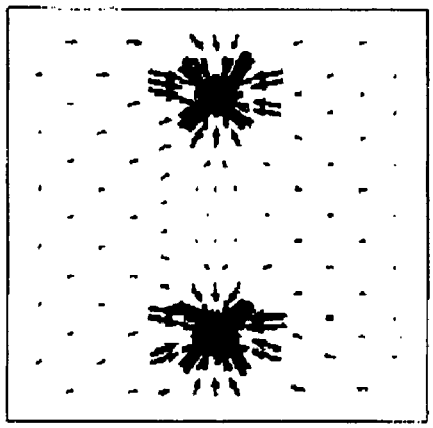

FIGS. 18A to 18C are views illustrating electric current distributions depending on adjustments of the distance between shorting pins in an antenna including two shorting pins according to an embodiment of the present invention. In the antenna structure having two shorting pins according to an embodiment of the present invention, the two shorting pins are connected to a rectangular patch. A rectangular spiral strip line has a total length $l_s$ of 23.73 mm and a line width $w_s$ of 0.5 mm. The spiral strip line is located at a height $h_f$ of 8.5 mm, and an interval d between a probe and the shorting pin is 4.2 mm.

In such a structure, electric current distributions in the rectangular patch according to alignment interval g between the shorting pins are illustrated in FIGS. 18A to 18C. That is, FIGS. 18A to 18C illustrate electric current distributions in rectangular patches at the respective relevant resonant frequencies when two shorting pins separated by an alignment interval of 2.5 mm, 4.5 mm, and 6.5 mm, respectively. Referring to FIGS. 18A to 18C, little current flows in the center of the patch (i.e., between the shorting pins) but currents to flow from the edge part to the shorting pins, such that a route of current becomes short. As a result, in-phase currents flows at the two shorting pins electromagnetically connected to a feed probe, and the electric potential difference between the two shorting pins becomes "0".

When the two shorting pins connected to a rectangular patch are aligned in a narrow interval, the electric current distribution of flowing uniformly to the four directions similarly to that in a case of a single shorting pin. However, as the alignment interval between the shorting pins becomes wider, electric current does not flow in the center position of the rectangular patch (i.e., in the position between two shorting pins having no electric potential difference). In this case, an electric current distribution area of the rectangular patch is reduced, and a resonant frequency of the shorted rectangular patch increases.

Figure 19A:
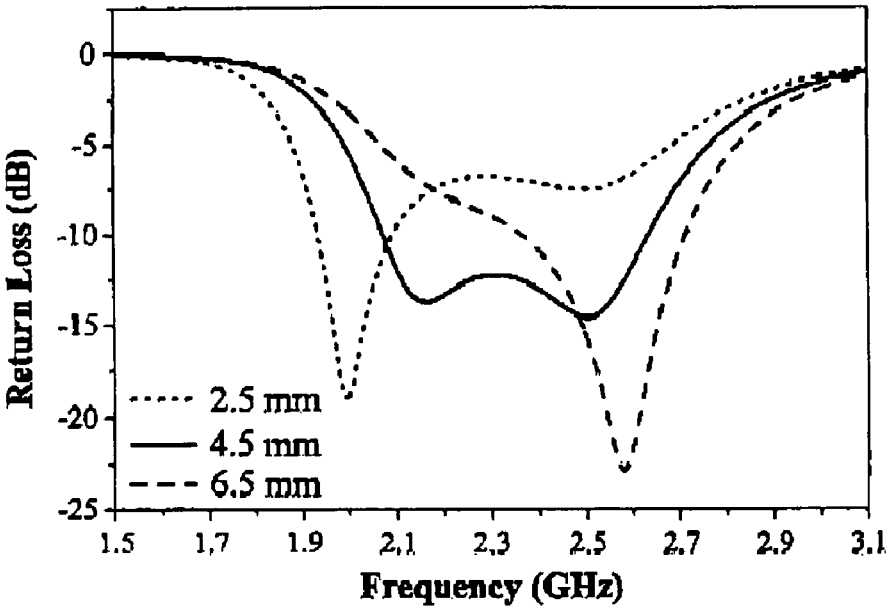
FIGS. 19A and 19B are graphs illustrating return losses and impedance variations depending to adjustment of a distance between shorting pins in an antenna structure having two shorting pins according to an embodiment of the present invention.
Figure 19B:
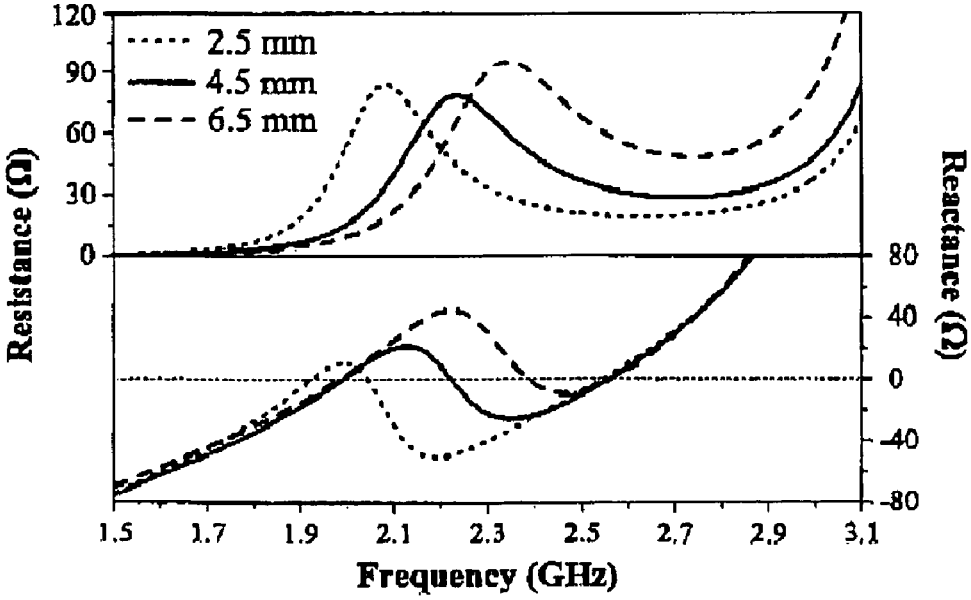

FIGS. 19A and 19B are graphs illustrating return losses and impedance variations depending on adjustments of the distance between shorting pins in an antenna structure having two shorting pins according to an embodiment of the present invention. Referring to FIG. 19A, when an alignment interval between the two shorting pins increases from 2.5 mm, to 4.5 mm, and to 6.5 mm, a resonant frequency of an antenna increases from about 2.05 GHz to about 2.4 GHz. More specifically, using imaginary numbers, when the alignment interval is 2.5 mm, a reactance of the antenna is shown as a capacitance component when an alignment interval is 2.5 mm, but when the alignment interval increases to 6.5 mm, the capacitance component decreases and an inductance component increases in the rectangular patch.

As a result illustrated in FIGS. 16A to 19B, it can be confirmed that variations of alignment intervals and the number of shorting pins connected to a rectangular patch causes a change of a reactance values of an antenna, such that a resonant frequency can move by adjusting the shorting pins. Therefore, it is possible to design an optimized antenna using changes of characteristics according to changes in an alignment interval and/or the number of shorting pins connected to a rectangular patch.

TABLE 4

| | Design Parameters | One shorting pin | Two shorting pins | Three shorting pins |
|---|---|---|---|---|
| Rectangular spiral strip line fed to probe | $l_s$ | 40.73 | 29.68 | 19.08 |
| | $H_f$ | 6.9 | 8.4 | 9.3 |
| | d | 3.7 | 3.9 | 4.4 |
| | $w_s$ | | 0.5 | |
| | a | | 1.3 | |
| | $\phi_2$ | | 0.86 | |
| Shorted rectangular patch | L | | 11.0 | |
| | W | | 11.0 | |
| | h | | 11.0 | |
| | $h_1$ | | 1.27 | |
| | $h_2$ | | 0.183 | |
| | g | | 3.0 | |
| | $\phi_1$ | | 1.0 | |

Table 4 shows design parameters for an optimized antenna when the antenna includes one, two, and three shorting pins connected to a rectangular patch, respectively, under the condition that a rectangular patch has dimensions of L=W=11.0 mm, a shorting pin has a diameter $\phi_1$ of 1.0 mm, and an alignment interval g between the shorting pins is 3.0 mm. As the number of shorting pins increases, the length $l_s$ of a rectangular spiral strip line decreases from 40.73 mm to 19.08 mm because the capacitance of the antenna decreases according to the increase of the number of the shorting pins. Accordingly, it is necessary to also decrease the inductance of the antenna in order to facilitate generation of resonance.

In addition, optimized design parameters having the maximum bandwidth are determined by adjusting a height of the probe and a distance between a shorting pin and the probe.

Figure 20:
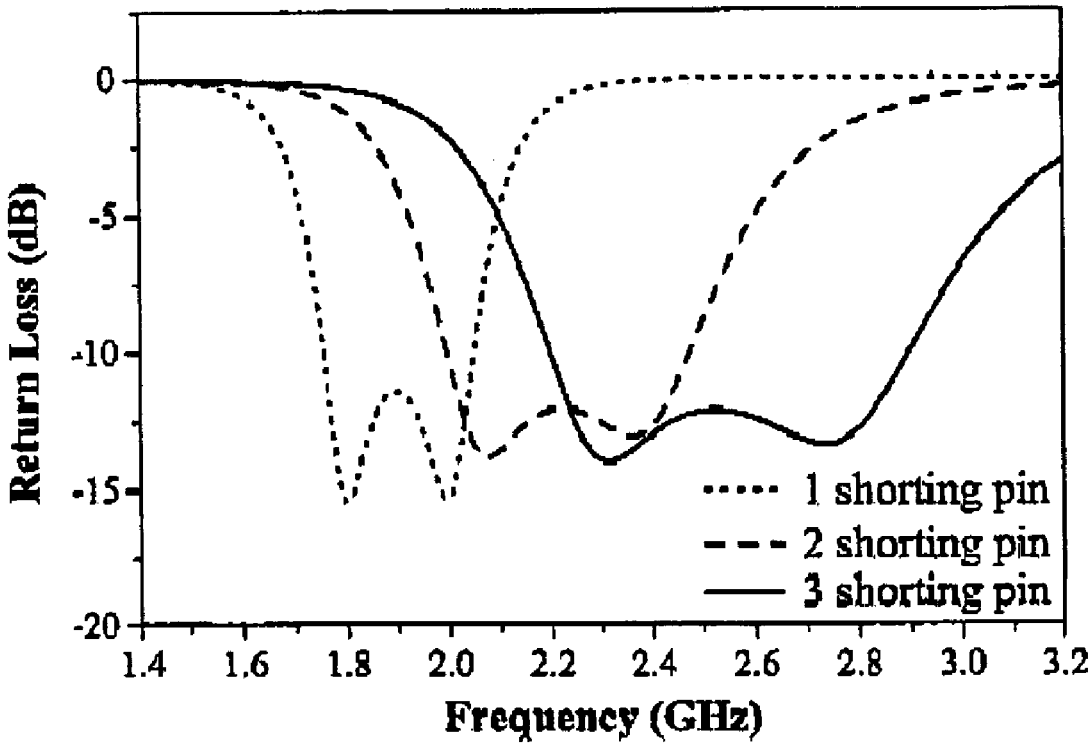
FIG. 20 is a graph illustrating return losses of antennas optimized according to a number of shorting pins, which are connected to the rectangular patch designed with parameters shown in Table 4.

FIG. 20 is a graph illustrating return losses of antennas optimized according to the number of the shorting pins that are connected to the rectangular patch designed with parameters shown in Table 4.

Table 5 shows characteristics of antennas optimized according to the number of the shorting pins that are connected to the rectangular patch as described with reference to FIG. 20.

TABLE 5

| | Center frequency (GHz) | Bandwidth (%) | Electrical Volume ($\lambda_0$) |
|---|---|---|---|
| One shorting pin | 1.9 | 1.753 GHz~2.047 GHz (15.47%) | 0.07 $\lambda_0$ × 0.07 $\lambda_0$ × 0.07 $\lambda_0$ |
| Two shorting pins | 2.333 | 1.995 GHz~2.471 GHz (21.32%) | 0.082 $\lambda_0$ × 0.082 $\lambda_0$ × 0.082 $\lambda_0$ |
| Three shorting pins | 2.54 | 2.197 GHz~2.897 GHz (27.56%) | 0.093 $\lambda_0$ × 0.093 $\lambda_0$ × 0.093 $\lambda_0$ |

Referring to FIG. 20 and Table 5, when a single shorting pin is connected to a rectangular patch, an antenna has a bandwidth of a range from 1.753 GHz to 2.047 GHz on the basis of "VSWR≦2", and has a bandwidth of 15.47% at the center frequency of 1.9 GHz. When two shorting pins are connected to a rectangular patch, an antenna has a bandwidth of a range from 0.1.995 GHz to 2.471 GHz, and has a bandwidth of 21.32% at the center frequency of 2.333 GHz. When three shorting pins are connected to a rectangular patch, an antenna has a bandwidth of a range from 2.197 GHz to 2.897 GHz and has a bandwidth of 27.56% at the center frequency of 2.54 GHz.

Additionally, an electrical volume of an antenna at a center frequency on the basis of a wavelength $\lambda_0$ of a free space is "0.07 $\lambda_0$×0.07 $\lambda_0$×0.07 $\lambda_0$" when a single shorting pin is connected to a rectangular patch, is "0.082 $\lambda_0$×0.082 $\lambda_0$×0.082 $\lambda_0$" when two shorting pins are connected to a rectangular patch, and is "0.093 $\lambda_0$×0.093 $\lambda_0$×0.093 $\lambda_0$" when three shorting pins are connected to a rectangular patch. From this, it can be understood that electrical size is small.

FIGS. 21A to 23B are views illustrating radiation patterns calculated in a x-z plane and a y-z plane within a frequency range of a bandwidth when an antenna has one, two, and three shorting pins, respectively. In FIGS. 21A to 23B, it is assumed that an antenna has a main beam at about "θ=72°" and has a monopole type of radiation pattern in which radiation is transmitted in all directions of Φ.

Figure 21A:
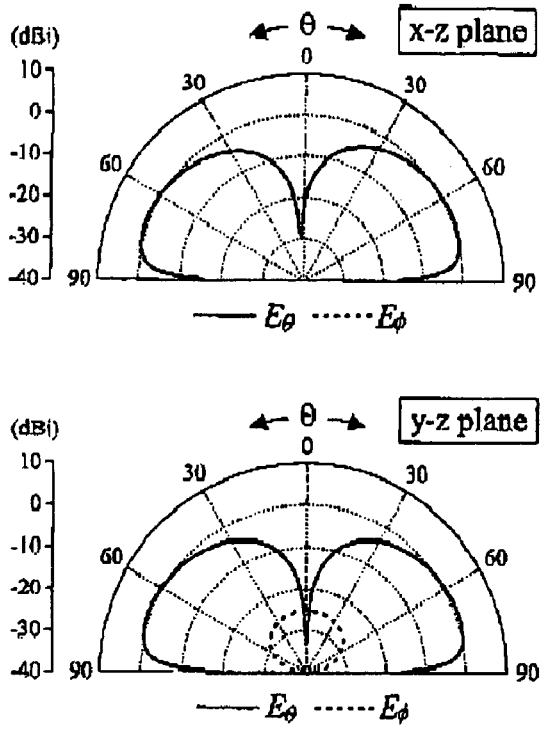
FIGS. 21A and 21B illustrate radiation patterns of an antenna having a single shorting pin, at frequencies of 1.8 GHz and 2.0 GHz, respectively.
Figure 21B:
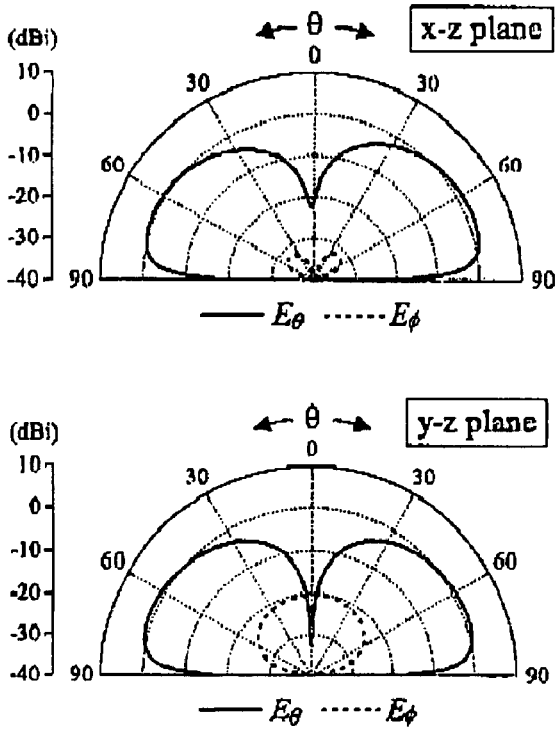

More specifically, FIGS. 21A and 21B illustrate radiation patterns of an antenna having a single shorting pin, with respect to frequencies of 1.8 GHz and 2.0 GHz, respectively. When the antenna has a single shorting pin, the maximum gain of the antenna is 0.7 dBi at 1.8 GHz, and 1.2 dBi at 2.0 GHz.

Figure 22A:
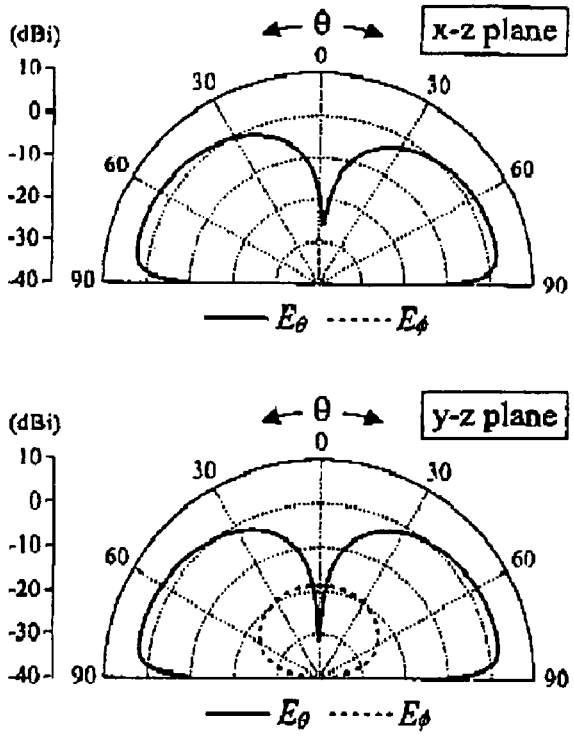
FIGS. 22A and 22B illustrates radiation patterns of an antenna having two shorting pins, at frequencies of 2.1 GHz and 2.4 GHz, respectively.
Figure 22B:
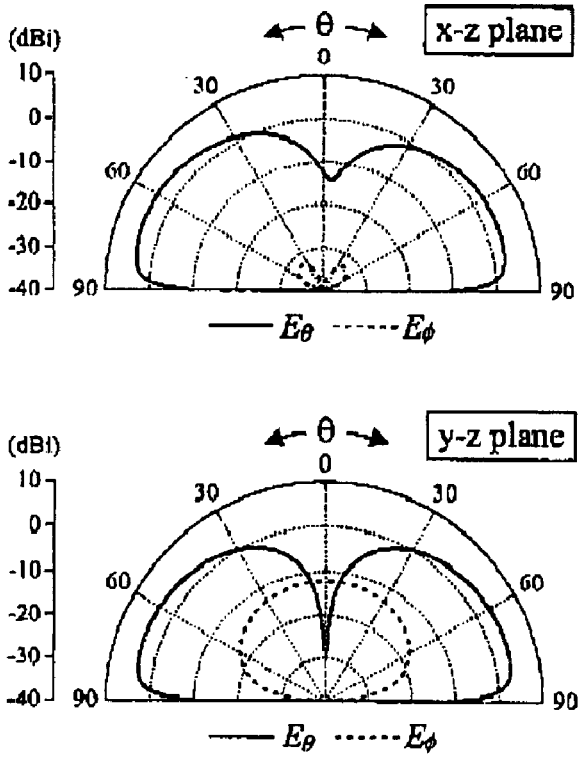

FIGS. 22A and 22B illustrates radiation patterns of an antenna having two shorting pins, with respect to frequencies of 2.1 GHz and 2.4 GHz, respectively. When there are two shorting pins, the maximum gain of the antenna is 3.0 dBi at 2.1 GHz, and 4.0 dBi at 2.4 GHz.

Figure 23A:
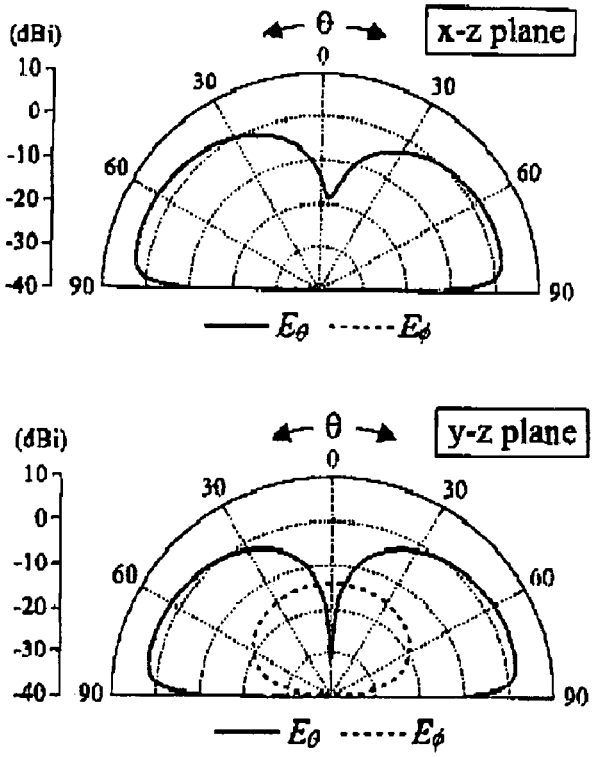
FIGS. 23A and 23B illustrates radiation patterns of an antenna having three shorting pins, at to frequencies of 2.3 GHz and 2.7 GHz, respectively.
Figure 23B:
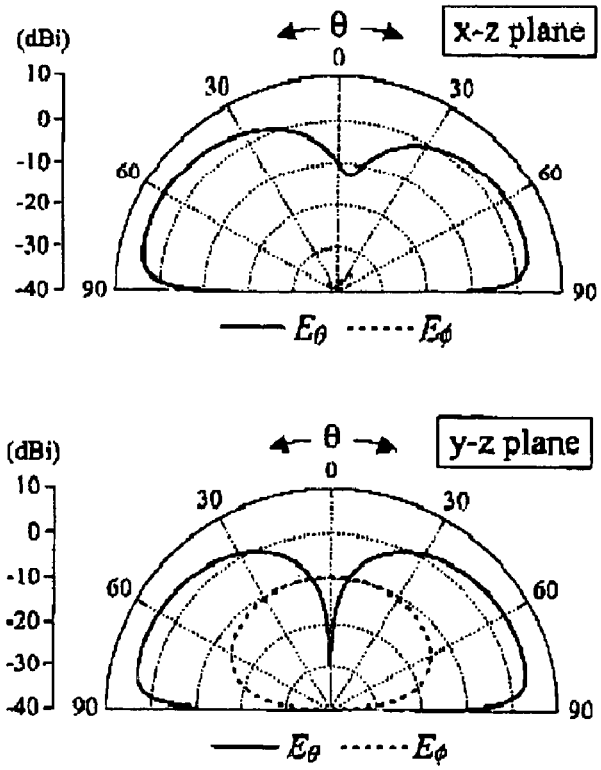

FIGS. 23A and 23B illustrates radiation patterns of an antenna having two shorting pins, with respect to frequencies of 2.3 GHz and 2.7 GHz, respectively. When there are three shorting pins, the maximum gain of the antenna is 3.5 dBi at 2.3 GHz, and 4.8 dBi at 2.7 GHz.

Figure 24:
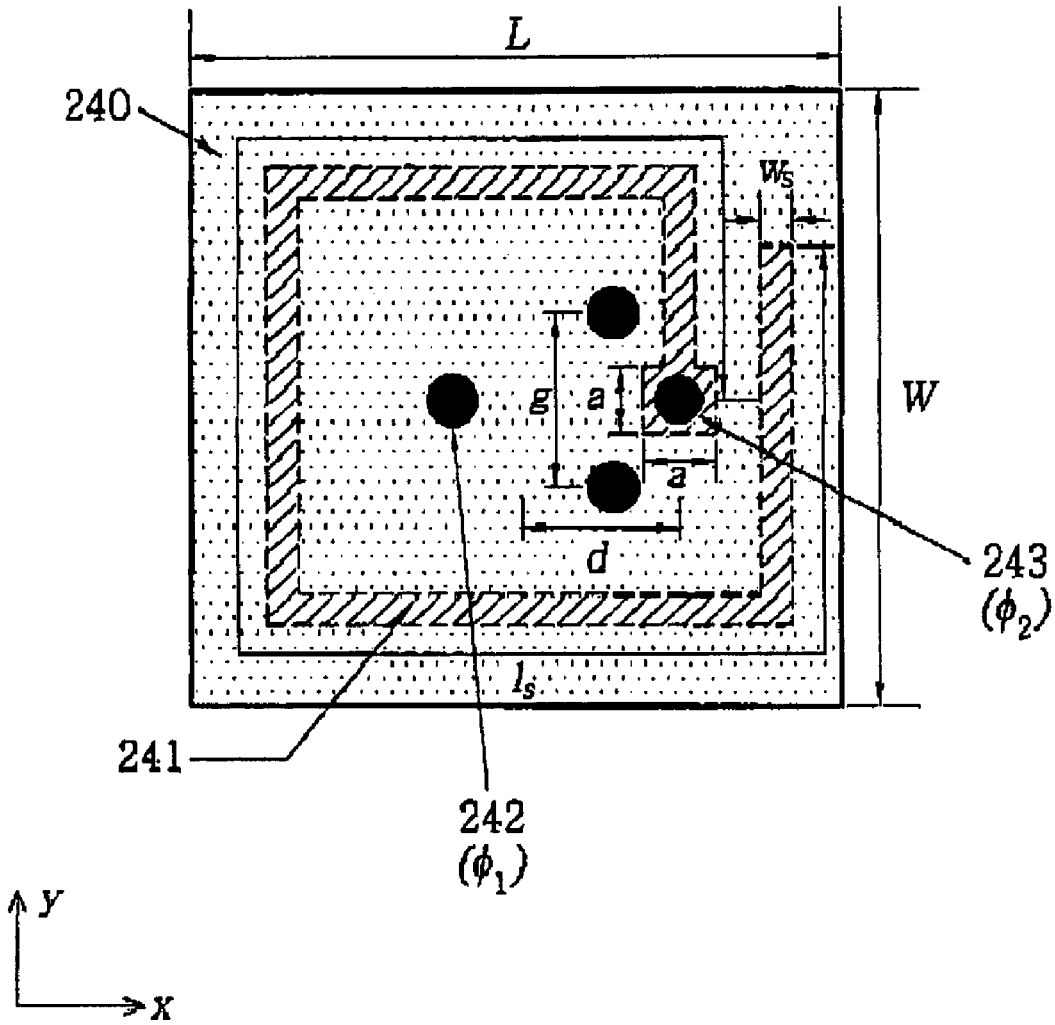
FIG. 24 is a view illustrating an antenna having three shorting pins according to yet another embodiment of the present invention.

FIG. 24 is a view illustrating an antenna having three shorting pins according to yet another embodiment of the present invention. In FIG. 24, unlike an alignment structure of three shorting pins illustrated in FIG. 15C, the shorting pins may be aligned in a triangular shape without being aligned in a straight line. In this case, a distance d between a probe and the three shorting pins and a distance g between the respective shorting pins become subjects in question. That is, in FIG. 24, a distance d between a probe and the three shorting pins is calculated on the basis of the center of gravity of a triangle formed by imaginary lines connecting the three shorting pins. In addition, it is assumed that the respective shorting pins are equidistant.

Figure 25:
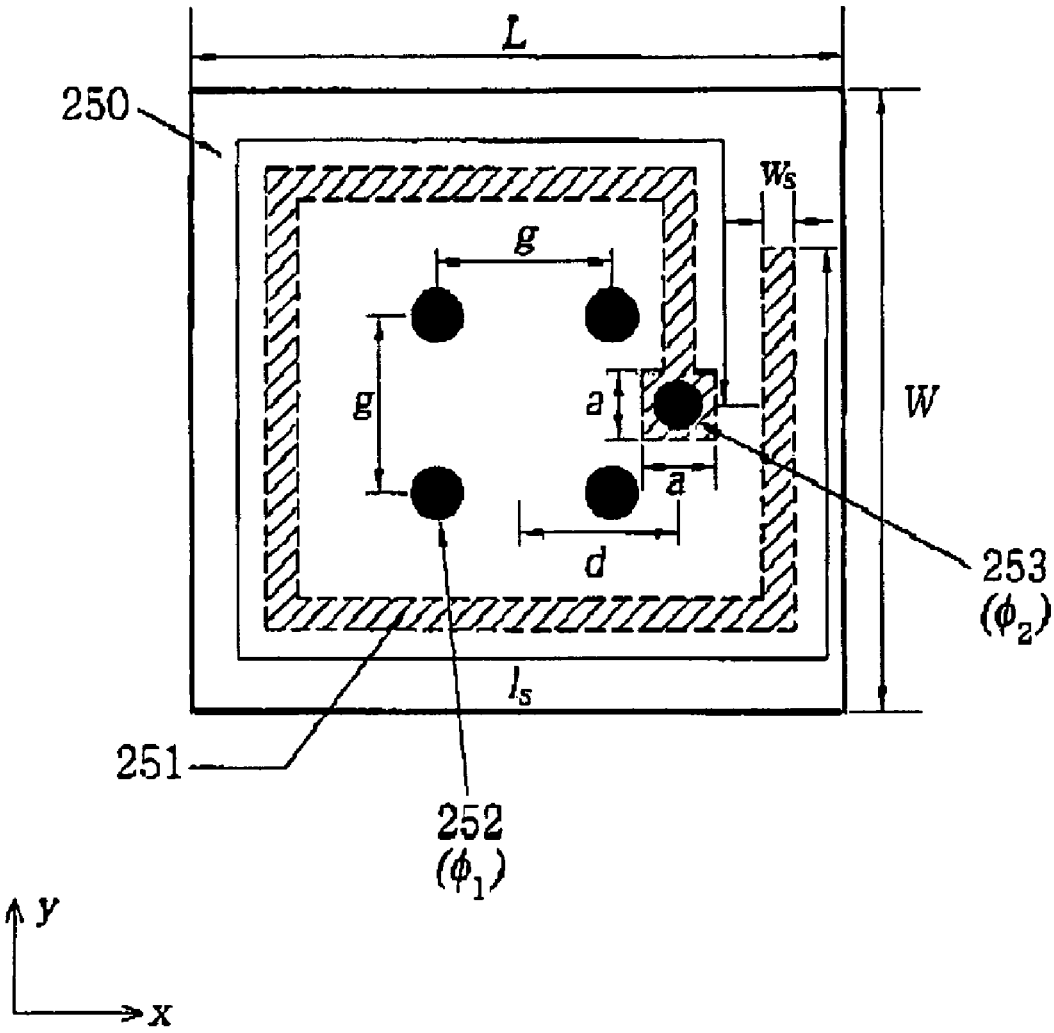
FIG. 25 is a view illustrating an antenna having four shorting pins according to still another embodiment of the present invention.

FIG. 25 is a view illustrating an antenna having four shorting pins according to still another embodiment of the present invention. More specifically, FIG. 25 illustrates the four shorting pins aligned in a square form, without being aligned in a straight line.

In FIG. 25, a distance d between a probe and the four shorting pins is calculated on the basis of the center of gravity of a square formed by imaginary lines connected among the four shorting pins. In addition, it is assumed that the distance between the shorting pins made in rectangular sides is equidistant.

As described above, a plurality of shorting pins may be aligned in a line form, a triangle form, or a square form, on a rectangular patch, and consequently, the shorting pins may be aligned in a random form on a rectangular patch. When the shorting pins are aligned in a random form, parameters d and g are calculated according to a relevant form.

As described above, the present invention suggests a monopole antenna and its equivalent model that the probe with a strip line, where the strip line can be the spiral type or the folded type, and the shorted patch are electromagnetically coupled. The monopole antenna provides a low resonance by compensating the capacitive component of the shorted patch with the inductive component of the probe with a strip line. In addition, the monopole antenna is advantageous in realizing a wide single-band and a dual-band because the resonance frequencies of the shorted patch and the probe with a strip line are adjustable by varying the antenna design parameters. Specifically, the wide bandwidth can be obtained by electromagnetic coupling the shorted patch to the probe with a strip line, thereby combining the resonance by the probe with a strip line and the resonance by the shorted patch. Therefore, in this antenna, changing the inductance and the capacitance is available by adjusting the design parameters of the probe with a strip line and the shorted patch. As such, the resonance of the probe with a strip line and the resonance of the shorted patch can be adjusted by varying the inductance and the capacitance. Consequently, it is possible to design an antenna having a characteristic of a wideband or a dual-band by varying a resonance frequency.

In addition, the design scheme of the present invention enables the antenna structure to be small if a dielectric material of a high permittivity is used for the shorted patch. The probe with a strip line can have the maximum resonance length within the minimum volume by constructing the strip line as a modified type such as a spiral type, a folded type, or a helical type. Preferably, the total length of the modified strip line and the probe as such is equal to a length of about 0.25λ. In other words, the miniaturization of the monopole antenna according to the present invention can be achieved by modifying the probe with a strip line to have 0.25λ resonance length in the minimum volume.

Furthermore, it is also possible to adjust the impedance matching characteristic by using the electromagnetic coupling between the shorted patch and the probe with a strip line. In the antenna structure according to the present invention, it is possible to achieve, without any separate matching circuit, a wide bandwidth by improving the impedance matching characteristic because the capacitance of the shorted patch and the inductance of the probe with the strip line can be adjusted in the antenna itself.

According to the experimental data, both the antenna having a rectangular spiral strip line and the antenna having a folded strip line have a bandwidth of 16.5% at the center frequency 2.0 GHz, while the antenna having a circular spiral strip line has a bandwidth of 17.4% at the center frequency 2.15 GHz. The present antenna has an omni-directional radiation pattern. Therefore, it can be said that the antenna suggested by the present invention is applicable as an embedded antenna for the mobile communication terminals such as the cellular phone, the PCS phone, the IMT-2000 terminal, PDA, or WLAN applications.

It should be noted that although optimum embodiments have been described above, it is apparent that variations and modifications by those skilled in the art can be effected within the spirit and scope of the present invention defined in the appended claims. Therefore, all variations and modifications equivalent to the appended claims are within the scope of the present invention.

While the present invention has been shown and described with reference to certain preferred embodiments thereof, it will be understood by those skilled in the art that various changes in form and details may be made therein without departing from the spirit and scope of the present invention as defined by the appended claims.

What is claimed is:

1. A monopole antenna, comprising:

a probe having one of a strip line and a wire of a predetermined length, the strip line being probe-fed by a coaxial line at a predetermined height from a ground plane; and a shorted patch, wherein the shorted patch is electromagnetically coupled to the probe and has a center that is connected to the ground plane via a shorting pin.

2. The monopole antenna as claimed in claim 1, wherein the predetermined length has a value between $0.24\lambda_0$ and $0.26\lambda_0$, where $\lambda_0$ is a wavelength in free space.

3. The monopole antenna as claimed in claim 1, wherein the one of the strip line and the wire has a shape selected from a group of a spiral shape, a helix shape, and a folded shape that is made by folding a straight strip line or wire.

4. The monopole antenna as claimed in claim 1, wherein the shorted patch operates as a monopole antenna with a capacitive component when the probe operates as a monopole antenna with an inductive component such that the capacitive component of the shorted patch is compensated by an inductive component of the probe, thereby providing a low resonance frequency.

5. The monopole antenna as claimed in claim 1, wherein the antenna provides a wide single-bandwidth when a resonance frequency of the probe and a resonance frequency of the shorted patch are adjacent with each other.

6. The monopole antenna as claimed in claim 1, wherein the antenna provides a dual-band when a resonance frequency of the probe and a resonance frequency of the shorted patch are different from each other.

7. The monopole antenna as claimed in claim 1, wherein the antenna has an omni-directional radiation pattern.

8. The monopole antenna as claimed in claim 1, wherein the strip line is a rectangular spiral strip line, and a sum of a length of the rectangular spiral strip line and a probe height from the ground plane has a value between $0.24\lambda_0$ and $0.26\lambda_0$, where $\lambda_0$ is a wavelength in free space, and wherein the shorted patch is a rectangular plate, occupying an area wider than the rectangular spiral strip line.

9. The monopole antenna as claimed in claim 8, further comprising a dielectric substrate disposed between the shorted patch and the strip line.

10. The monopole antenna as claimed in claim 8, further comprising a predetermined number of shorting pins by which reactance of the antenna can be adjusted.

11. The monopole antenna as claimed in claim 10, wherein the shorting pins are arranged in a predetermined shape in the shorted patch.

12. The monopole antenna as claimed in claim 11, wherein the bandwidth of the antenna is adjusted by adjusting an electromagnetic coupling force by changing a distance between the shorting pins and the probe.

13. The monopole antenna as claimed in claim 12, wherein the distance between the shorting pins and the probe equals a distance between the probe and a gravity center of the shorting pins.

14. The monopole antenna as claimed in claim 11, wherein the resonance frequency of the antenna is adjusted by changing an alignment interval between the shorting pins.

15. The monopole antenna as claimed in claim 11, wherein the bandwidth of the antenna is adjusted by changing an alignment interval between the shorting pins.

16. The monopole antenna as claimed in claim 11, wherein the resonance frequency of the antenna is adjusted by changing the number of the shorting pins.

17. The monopole antenna as claimed in claim 11, wherein the bandwidth of the antenna is adjusted by changing the number of the shorting pins.

18. The monopole antenna as claimed in claim 1, wherein the strip line is a circular spiral strip line, and a sum of a length of the circular spiral strip line and a probe height from the ground plane has a value between $0.24\lambda_0$ and $0.26\lambda_0$, where $\lambda_0$ is a wavelength in free space, and wherein the shorted patch is a rectangular patch, occupying an area wider than the circular spiral strip line.

19. The monopole antenna as claimed in claim 18, further comprising a dielectric substrate disposed between the shorted patch and the strip line.

20. The monopole antenna as claimed in claim 18, further comprising a predetermined number of shorting pins by which reactance of the antenna can be adjusted.

21. The monopole antenna as claimed in claim 20, wherein the shorting pins are arranged in a predetermined shape in the shorted patch.

22. The monopole antenna as claimed in claim 21, wherein the bandwidth of the antenna is adjusted by adjusting an electromagnetic coupling force by changing a distance between the shorting pins and the probe.

23. The monopole antenna as claimed in claim 22, wherein the distance between the shorting pins and the probe equals a distance between the probe and a gravity center of the shorting pins.

24. The monopole antenna as claimed in claim 21, wherein the resonance frequency of the antenna is adjusted by changing an alignment interval between the shorting pins.

25. The monopole antenna as claimed in claim 21, wherein the bandwidth of the antenna is adjusted by changing an alignment interval between the shorting pins.

26. The monopole antenna as claimed in claim 21, wherein the resonance frequency of the antenna is adjusted by changing the number of the shorting pins.

27. The monopole antenna as claimed in claim 21, wherein the bandwidth of the antenna is adjusted by changing the number of the shorting pins.

28. The monopole antenna as claimed in claim 1, wherein the strip line is a folded strip line having an upper strip line and a lower strip line that are connected to have a space by a strip line, being fed by a probe at a predetermined height from a ground plane, and a sum of a length of the folded strip line and a probe height from the ground plane having a value between $0.24\lambda_0$ and $0.26\lambda_0$, where $\lambda_0$ is a wavelength in free space.

29. The monopole antenna as claimed in claim 28, further comprising a dielectric substrate disposed between the shorted patch and the strip line.

* * * * *